US011783656B1

(12) United States Patent
Min

(10) Patent No.: US 11,783,656 B1
(45) Date of Patent: Oct. 10, 2023

(54) SECURE ELECTRONIC LOCK SYSTEMS AND METHODS OF USING THE SAME

(71) Applicant: NANJING EASTHOUSE ELECTRICAL CO., LTD., Nanjing (CN)

(72) Inventor: Hao Min, Nanjing (CN)

(73) Assignee: NANJING EASTHOUSE ELECTRICAL CO., LTD., Nanjing (CN)

( * ) Notice: Subject to any disclaimer, the term of this patent is extended or adjusted under 35 U.S.C. 154(b) by 0 days.

(21) Appl. No.: 17/259,923

(22) PCT Filed: Dec. 30, 2020

(86) PCT No.: PCT/CN2020/141319
§ 371 (c)(1),
(2) Date: Jan. 12, 2021

(87) PCT Pub. No.: WO2022/141170
PCT Pub. Date: Jul. 7, 2022

(51) Int. Cl.
*G08B 21/00* (2006.01)
*G07C 9/27* (2020.01)
*G07C 9/00* (2020.01)

(52) U.S. Cl.
CPC ..... *G07C 9/27* (2020.01); *G07C 9/00309* (2013.01); *G07C 9/00912* (2013.01);
(Continued)

(58) Field of Classification Search
CPC .. G07C 9/27; G07C 9/00309; G07C 9/00912; G07C 2009/00412; G07C 2009/00984; G07C 2209/14
(Continued)

(56) References Cited

U.S. PATENT DOCUMENTS

2012/0047972 A1* 3/2012 Grant ..... E05B 47/06 70/77
2012/0096909 A1* 4/2012 Hart ..... H04B 5/0012 70/278.1
(Continued)

FOREIGN PATENT DOCUMENTS

CN 111779033 * 10/2020 ..... E02D 29/1481

*Primary Examiner* — Mark S Rushing
(74) *Attorney, Agent, or Firm* — Ming Jiang; MM IP SERVICES LLC

(57) ABSTRACT

Present disclosure relates a secure electronic lock system. Secure electronic lock system includes many secure electronic locks connected through a communication network to a secure electronic lock system server. Each secure electronic lock includes a passive electronic lock, an active electronic key and a passive electronic key. Active electronic key includes electrical power source providing electrical power supply to active electronic key, passive electronic lock and passive electronic key. When both active and passive electronic keys are inserted into respective electronic keyholes of passive electronic lock, both active and passive digital keys are transmitted to passive electronic lock, passive electronic lock can be locked and unlocked only when both active and passive digital keys received match prestored active and passive digital keys respectively. Active and passive digital keys are updated and an access event is transmitted to secure electronic lock system server every time each secure electronic lock is accessed.

20 Claims, 12 Drawing Sheets

(52) U.S. Cl.
CPC ..... *G07C 2009/00412* (2013.01); *G07C 2009/00984* (2013.01); *G07C 2209/14* (2013.01)

(58) Field of Classification Search
USPC ..... 340/5.65
See application file for complete search history.

(56) References Cited

U.S. PATENT DOCUMENTS

| | | | | |
|---|---|---|---|---|
| 2012/0252365 | A1* | 10/2012 | Lam | G07C 9/00309 455/41.2 |
| 2014/0118930 | A1* | 5/2014 | Sedon | G06F 21/88 361/679.56 |
| 2017/0236346 | A1* | 8/2017 | Murar | G07C 9/00309 340/5.61 |
| 2019/0272731 | A1* | 9/2019 | Fawcett | G08B 13/2434 |

* cited by examiner

SECURE ELECTRONIC LOCK SYSTEMS AND METHODS OF USING THE SAME

FIELD

The present disclosure generally relates to electronic lock, and more particularly to secure electronic locks, secure electronic lock systems and methods of using the secure electronic lock systems.

BACKGROUND

Safety deposit box is a secure container usually made of metal that's used to store valuables at a bank or credit union. These boxes are often kept in vaults and can be rented throughout the lifetime of a customer for an annual fee. Usually, opening the safety deposit box requires at least two keys, one for a bank management staff, and the other one for the customer. Both keys are required to open the safety deposit box. Currently, most banks still use mechanical safety deposit boxes with a set of keys. These mechanical lock's keys are easy to duplicate and the safety of the contents in the safety deposit box is not guaranteed. On the other hand, banks having the safety deposit boxes usually rely on video surveillance cameras to record access history of the safety deposit boxes. It is customary for the banks to keep the surveillance camera footages for 3 to 6 months. After that, the surveillance camera footages are erased leaving no trace for these months. Therefore, it is desirable to have electronic locks with their access events recorded through a secure electronic lock system server over a communication network after each electronic lock is accessed.

Therefore, heretofore unaddressed needs still exist in the art to address the aforementioned deficiencies and inadequacies.

SUMMARY

In one aspect, the present disclosure relates to a secure electronic lock. In certain embodiments, the secure electronic lock includes a passive electronic lock and a set of electronic keys. The set of electronic keys includes an active electronic key and at least a passive electronic key. The active electronic key stores an active digital key and the passive electronic key stores a passive digital key. The active electronic key includes an electrical power source and an electronic key communication module. The electrical power source provides electrical power supply to the active electronic key, the passive electronic lock and the passive electronic key. In certain embodiments, the electronic key communication module transmits an access event of the secure electronic lock to a secure electronic lock system server over a communication network after the secure electronic lock is accessed.

In certain embodiments, the passive electronic lock includes: a set of electronic keyholes and an electronic lock controller. The set of electronic keyholes includes an active electronic keyhole to receive the active electronic key and a passive electronic keyhole to receive the passive electronic key. The electronic lock controller includes an electronic lock processor, and an electronic lock non-volatile memory. The electronic lock non-volatile memory stores an electronic lock operating system and electronic lock computer executable instructions. The electronic lock computer executable instructions include: an electronic lock digital key storage module, an electronic lock digital key control module, an electronic lock digital key encryption/decryption module, an electronic lock digital key authentication module, an electronic lock electrical power module, and an electronic lock control module. When executed by the electronic lock processor, the electronic lock computer executable instructions cause the electronic lock processor to perform one or more of the following operations:

- receiving, via the electronic lock electrical power module, electrical power from an active electronic key power supply port of the electronic lock controller from the electrical power source of the active electronic key, when a first user inserts the active electronic key into the active electronic keyhole;
- providing, via the electronic lock electrical power module, electrical power to the passive electronic key through a passive electronic key power supply port of the electronic lock controller, when a second user inserts the passive electronic key into the passive electronic keyhole;
- receiving an encrypted active digital key from the active electronic key via an active communication channel of the electronic lock controller, and an encrypted passive digital key from the passive electronic key via a passive communication channel of the electronic lock controller, respectively;
- decrypting, by an electronic lock digital key encryption/decryption module of the passive electronic lock, the received encrypted active digital key from the active electronic key and the received encrypted passive digital key from the passive electronic key, and comparing, by an electronic lock digital key control module of the passive electronic lock, the decrypted active digital key and the decrypted passive digital key received with an active digital key and a passive digital key prestored in an electronic lock digital key storage module of the passive electronic lock;
- operate, by the electronic lock control module through an electronic locking mechanism, an electronic lock tongue to lock or unlock the passive electronic lock, when the electronic lock digital key authentication module determines that the active digital key and the passive digital key received match the active digital key and the passive digital key prestored in the electronic lock digital key storage module of the passive electronic lock, respectively; and
- transmitting, via the electronic key communication module, an access event of the secure electronic lock to the secure electronic lock system server over the communication network after the secure electronic lock is accessed.

In certain embodiments, when the active electronic key is inserted into the active electronic keyhole and the passive electronic key is inserted into the passive electronic keyhole, respectively, the active digital key from the active electronic key is encrypted by the electronic key digital key encryption/decryption module of the active electronic key and transmitted to the passive electronic lock. The passive digital key from the passive electronic key is encrypted by the electronic key digital key encryption/decryption module of the passive electronic key and transmitted to the passive electronic lock.

In certain embodiments, during an activation process of the secure electronic lock, the first user triggers an electronic lock activation mechanism of the passive electronic lock, the electronic lock digital key control module of the passive electronic lock sends an activation instruction to the active electronic key and the passive electronic key through the active communication channel and the passive communication channel, respectively. The activation instruction instructs the electronic key digital key control module of the active electronic key to generate an active digital key for the active electronic key and the electronic key digital key control module of the passive electronic key to generate a passive digital key for the passive electronic key. The active digital key generated is stored in the electronic key digital key storage module of the active electronic key and the passive digital key generated is stored in the electronic key digital key storage module of the passive electronic key. The active digital key generated is encrypted by the electronic key digital key encryption/decryption module of the active electronic key and transmitted to the electronic lock digital key storage module as the active digital key prestored and the passive digital key generated is encrypted by the electronic key digital key encryption/decryption module of the passive electronic key and transmitted to the electronic lock digital key storage module as the passive digital key prestored. The active digital key prestored and the passive digital key prestored are used for authentication of the active electronic key and the passive electronic key, respectively.

In certain embodiments, the passive electronic lock is to be locked and unlocked only when the active electronic key and the passive electronic key are simultaneously inserted into the active electronic keyhole and the passive electronic keyhole, respectively. The first user is a management staff of the secure electronic lock and uses the active electronic key, the second user is a customer and uses the passive electronic key.

In certain embodiments, the active digital key and the passive digital key received are decrypted by the electronic lock digital key encryption/decryption module of the passive electronic lock and authenticated by the electronic lock digital key control module of the passive electronic lock. When the electronic lock digital key authentication module determines that the active digital key and the passive digital key received match the active digital key and the passive digital key prestored in the electronic lock digital key storage module of the passive electronic lock, respectively, the electronic lock control module of the passive electronic lock operates the electronic lock tongue through the electronic locking mechanism to lock or unlock the passive electronic lock.

In certain embodiments, the passive electronic lock includes two communication channels and two electronic key power supply ports. The communication channels include the active communication channel for transmitting the active digital key between the active electronic key and the passive electronic lock and the passive communication channel for transmitting the passive digital key between the passive electronic key and the passive electronic lock. The electronic key power supply ports include the active electronic key power supply port for receiving electrical power supply from the active electronic key and the passive electronic key power supply port for providing electrical power supply to the passive electronic key from the active electronic key through the passive electronic lock.

In certain embodiments, each of the active electronic key and the passive electronic key includes: an electronic key processor and an electronic key non-volatile memory. The electronic key non-volatile memory stores an electronic key operating system and electronic key computer executable instructions. The electronic key computer executable instructions include: the electronic key digital key control module, the electronic key digital key storage module, the electronic key digital key encryption/decryption module, and an electronic key electrical power module.

In certain embodiments, during an activation process of the secure electronic lock, the electronic key digital key control module of the active electronic key generates an active digital key for the active electronic key and the electronic key digital key control module of the passive electronic key generates a passive digital key for the passive electronic key. The active digital key and the passive digital key generated are first stored in the electronic key digital key storage module of the active electronic key and the electronic key digital key storage module of the passive electronic key, respectively. The active digital key and the passive digital key generated are then encrypted using the electronic key digital key encryption/decryption module of the active electronic key and the passive electronic key, respectively, transmitted to and stored in the electronic lock digital key storage module of the passive electronic lock, respectively, for authentication of the active electronic key and the passive electronic key.

In certain embodiments, the electronic key digital key storage module of the active electronic key receives and stores the active digital key from the electronic key digital key control module of the active electronic key and the electronic key digital key storage module of the passive electronic key receives and stores the passive digital key from the electronic key digital key control module of the passive electronic key, respectively.

In certain embodiments, the electronic key digital key encryption/decryption module of the active electronic key encrypts the active digital key before being transmitted out, and the electronic key digital key encryption/decryption module of the passive electronic key encrypts the passive digital key before being transmitted out.

In certain embodiments, the electronic key electrical power module of the active electronic key receives electrical power supply from the electrical power source and provides electrical power supply to the passive electronic lock, and the electronic key electrical power module of the passive electronic key receives electrical power supply from the active electronic key through the passive electronic lock.

In certain embodiments, the active electronic key includes the electronic key communication module. The electronic lock communication module transmits an access event of the secure electronic lock to the secure electronic lock system server over the communication network after the secure electronic lock is accessed.

In another aspect, the present disclosure relates to a secure electronic lock system. In certain embodiments, the secure electronic lock system includes: a secure electronic lock system server, a communication network, and a group of secure electronic locks. Each of the secure electronic locks includes: a passive electronic lock and a set of electronic keys. The set of electronic keys includes an active electronic key storing an active digital key and a passive electronic key storing a passive digital key. The active electronic key includes an electrical power source. The electrical power source provides electrical power supply to the active electronic key, the passive electronic lock and the passive electronic key.

In certain embodiments, the passive electronic lock includes: a set of electronic keyholes for receiving the set of electronic keys, and an electronic lock controller. The set of electronic keyholes includes: an active electronic keyhole for receiving the active electronic key and a passive electronic keyhole for receiving the passive electronic key. The electronic lock controller includes an electronic lock processor, and an electronic lock non-volatile memory storing an electronic lock operating system and electronic lock computer executable instructions. The electronic lock computer executable instructions include: an electronic lock digital key storage module, an electronic lock digital key control module, an electronic lock digital key encryption/decryption module, an electronic lock digital key authentication module, an electronic lock electrical power module, an electronic lock control module, and an electronic lock communication module.

In certain embodiments, when executed by the electronic lock processor, the electronic lock computer executable instructions cause the electronic lock processor to perform one or more of the following operations:

receiving, via the electronic lock electrical power module, electrical power from an active electronic key power supply port of the electronic lock controller from the electrical power source of the active electronic key, when a first user inserts the active electronic key into the active electronic keyhole;

providing, via the electronic lock electrical power module, electrical power to the passive electronic key through a passive electronic key power supply port of the electronic lock controller, when a second user inserts the passive electronic key into the passive electronic keyhole;

receiving an encrypted active digital key from the active electronic key via an active communication channel of the electronic lock controller, and an encrypted passive digital key from the passive electronic key via a passive communication channel of the electronic lock controller, respectively;

decrypting, by an electronic lock digital key encryption/decryption module of the passive electronic lock, the received encrypted active digital key from the active electronic key and the received encrypted passive digital key from the passive electronic key, and comparing, by an electronic lock digital key control module of the passive electronic lock, the decrypted active digital key and the decrypted passive digital key received with an active digital key and a passive digital key prestored in an electronic lock digital key storage module of the passive electronic lock;

operate, by the electronic lock control module through an electronic locking mechanism, an electronic lock tongue to lock or unlock the passive electronic lock, when the electronic lock digital key authentication module determines that the active digital key and the passive digital key received match the active digital key and the passive digital key prestored in the electronic lock digital key storage module of the passive electronic lock, respectively; and transmitting, via the electronic lock communication module, an access event of the secure electronic lock to the secure electronic lock system server over the communication network after the secure electronic lock is accessed.

In certain embodiments, when the active electronic key is inserted into the active electronic keyhole and the passive electronic key is inserted into the passive electronic keyhole, respectively, the active digital key from the active electronic key is encrypted by the electronic key digital key encryption/decryption module of the active electronic key and transmitted to the passive electronic lock, and the passive digital key from the passive electronic key is encrypted by the electronic key digital key encryption/decryption module of the passive electronic key and transmitted to the passive electronic lock.

In certain embodiments, the passive electronic lock includes an electronic lock controller having an electronic lock processor, and an electronic lock non-volatile memory. The electronic lock non-volatile memory stores an electronic lock operating system and electronic lock computer executable instructions. The electronic lock computer executable instructions include: the electronic lock digital key storage module, the electronic lock digital key control module, the electronic lock digital key encryption/decryption module, the electronic lock digital key authentication module, an electronic lock electrical power module, the electronic lock control module, and the electronic lock communication module.

In certain embodiments, the electronic lock digital key storage module receives the active digital key from the active electronic key and the passive digital key from the passive electronic key generated during an activation process of the secure electronic lock, and stores the active digital key and the passive digital key received in the electronic lock digital key storage module of the passive electronic lock as the active digital key and the passive digital key prestored in the electronic lock digital key storage module of the passive electronic lock for authentication of the active electronic key and the passive electronic key, respectively.

In certain embodiments, the electronic lock digital key control module receives the active digital key when the active electronic key is inserted in the active electronic keyhole and the passive digital key when the passive electronic key is inserted in the passive electronic keyhole, and compares the active digital key and the passive digital key received with the active digital key and the passive digital key prestored in the electronic lock digital key storage module of the passive electronic lock.

In certain embodiments, the electronic lock digital key encryption/decryption module decrypts the active digital key and the passive digital key received. The electronic lock digital key authentication module determines whether the active digital key and the passive digital key received match the active digital key and the passive digital key prestored in the electronic lock digital key storage module of the passive electronic lock.

In certain embodiments, the electronic lock electrical power module receives electrical power supply from the electrical power source of the active electronic key through the active electronic key power supply port and provides electrical power supply to the passive electronic key through the passive electronic key power supply port. The electronic lock control module controls the operation of the electronic locking mechanism to lock and unlock the passive electronic lock.

In certain embodiments, the electronic lock communication module transmits an access event of the secure electronic lock to the secure electronic lock system server over the communication network after the secure electronic lock is accessed.

In certain embodiments, the passive electronic lock is to be locked and unlocked only when the active electronic key and the passive electronic key are simultaneously inserted into the active electronic keyhole and the passive electronic keyhole, respectively. The first user is a management staff of the secure electronic lock and uses the active electronic key, the second user is a customer and uses the passive electronic key.

In certain embodiments, the active digital key and the passive digital key received are decrypted by the electronic lock digital key encryption/decryption module of the passive electronic lock and authenticated by the electronic lock digital key control module of the passive electronic lock. When the electronic lock digital key authentication module determines that the active digital key and the passive digital key received match the active digital key and the passive digital key prestored in the electronic lock digital key storage module of the passive electronic lock, respectively, the electronic lock control module of the passive electronic lock operates the electronic lock tongue through the electronic locking mechanism to lock or unlock the passive electronic lock.

In certain embodiments, the passive electronic lock includes two communication channels and two electronic key power supply ports. The communication channels include the active communication channel for transmitting the active digital key between the active electronic key and the passive electronic lock and the passive communication channel for transmitting the passive digital key between the passive electronic key and the passive electronic lock. The electronic key power supply ports include the active electronic key power supply port for receiving electrical power supply from the active electronic key and the passive electronic key power supply port for providing electrical power supply to the passive electronic key from the active electronic key through the passive electronic lock.

In yet another aspect, the present disclosure relates to a method of using a secure electronic lock system. In certain embodiments, the method includes:

installing the secure electronic lock system. The secure electronic lock system includes: a secure electronic lock system server, a communication network, and many secure electronic locks, each of the secure electronic locks is connected to the secure electronic lock system server over the communication network. Each of the secure electronic locks includes: an active electronic key, a passive electronic key, and a passive electronic lock. The passive electronic lock includes a set of electronic keyholes: an active electronic keyhole for receiving the active electronic key and a passive electronic keyhole for receiving the passive electronic key;

inserting, by a first user, the active electronic key into the active electronic keyhole of the passive electronic lock. The active electronic key includes an electrical power source to provide electrical power supply to the passive electronic lock through an active electronic key power supply port of the active electronic key, and to provide an encrypted active digital key to the passive electronic lock through an active communication channel of the active electronic key;

while the active electronic key is inserted in the active electronic keyhole, inserting, by a second user the passive electronic key into the passive electronic keyhole of the passive electronic lock to receive electrical power supply from the passive electronic lock through a passive electronic key power supply port of the passive electronic key, and to provide an encrypted passive digital key to the passive electronic lock through a passive communication channel of the passive electronic key;

decrypting, by an electronic lock digital key encryption/decryption module of the passive electronic lock, the received encrypted active digital key from the active electronic key and the received encrypted passive digital key from the passive electronic key, and comparing, by an electronic lock digital key control module of the passive electronic lock, the decrypted active digital key and the decrypted passive digital key received with an active digital key and a passive digital key prestored in an electronic lock digital key storage module of the passive electronic lock;

when an electronic lock digital key authentication module of the passive electronic lock determines that the active digital key and the passive digital key received match the active digital key and the passive digital key prestored in the electronic lock digital key storage module of the passive electronic lock, respectively, operating, by the electronic lock digital key control module of the passive electronic lock, an electronic lock tongue of the passive electronic lock through an electronic lock control module and an electronic locking mechanism to lock and unlock the passive electronic lock; and transmitting, via an electronic lock communication module of the passive electronic lock, an access event of the secure electronic lock to the secure electronic lock system server over the communication network after the secure electronic lock is accessed.

In certain embodiments, the passive electronic lock includes an electronic lock controller having an electronic lock processor, and an electronic lock non-volatile memory. The electronic lock non-volatile memory stores an electronic lock operating system and electronic lock computer executable instructions. The electronic lock computer executable instructions include: the electronic lock digital key storage module, the electronic lock digital key control module, the electronic lock digital key encryption/decryption module, the electronic lock digital key authentication module, an electronic lock electrical power module, the electronic lock control module, and the electronic lock communication module.

In certain embodiments, the electronic lock digital key storage module receives the active digital key from the active electronic key and the passive digital key from the passive electronic key generated during an activation process of the secure electronic lock, and stores the active digital key and the passive digital key received in the electronic lock digital key storage module of the passive electronic lock as the active digital key and the passive digital key prestored in the electronic lock digital key storage module of the passive electronic lock for authentication of the active electronic key and the passive electronic key, respectively.

In certain embodiments, the electronic lock digital key control module receives the active digital key when the active electronic key is inserted in the active electronic keyhole and the passive digital key when the passive electronic key is inserted in the passive electronic keyhole, and compares the active digital key and the passive digital key received with the active digital key and the passive digital key prestored in the electronic lock digital key storage module of the passive electronic lock.

In certain embodiments, the electronic lock digital key encryption/decryption module decrypts the active digital key and the passive digital key received. The electronic lock digital key authentication module determines whether the active digital key and the passive digital key received match the active digital key and the passive digital key prestored in the electronic lock digital key storage module of the passive electronic lock.

In certain embodiments, the electronic lock electrical power module receives electrical power supply from the electrical power source of the active electronic key through the active electronic key power supply port and provides electrical power supply to the passive electronic key through the passive electronic key power supply port. The electronic lock control module controls the operation of the electronic locking mechanism to lock and unlock the passive electronic lock.

In certain embodiments, the electronic lock communication module transmits an access event of the secure electronic lock to the secure electronic lock system server over the communication network after the secure electronic lock is accessed.

These and other aspects of the present disclosure will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the present disclosure, and features and benefits thereof, and together with the written description, serve to explain the principles of the present invention. Wherever possible, the same reference numbers are used throughout the drawings to refer to the same or like elements of an embodiment, and wherein.

DETAILED DESCRIPTION

Figure 1:
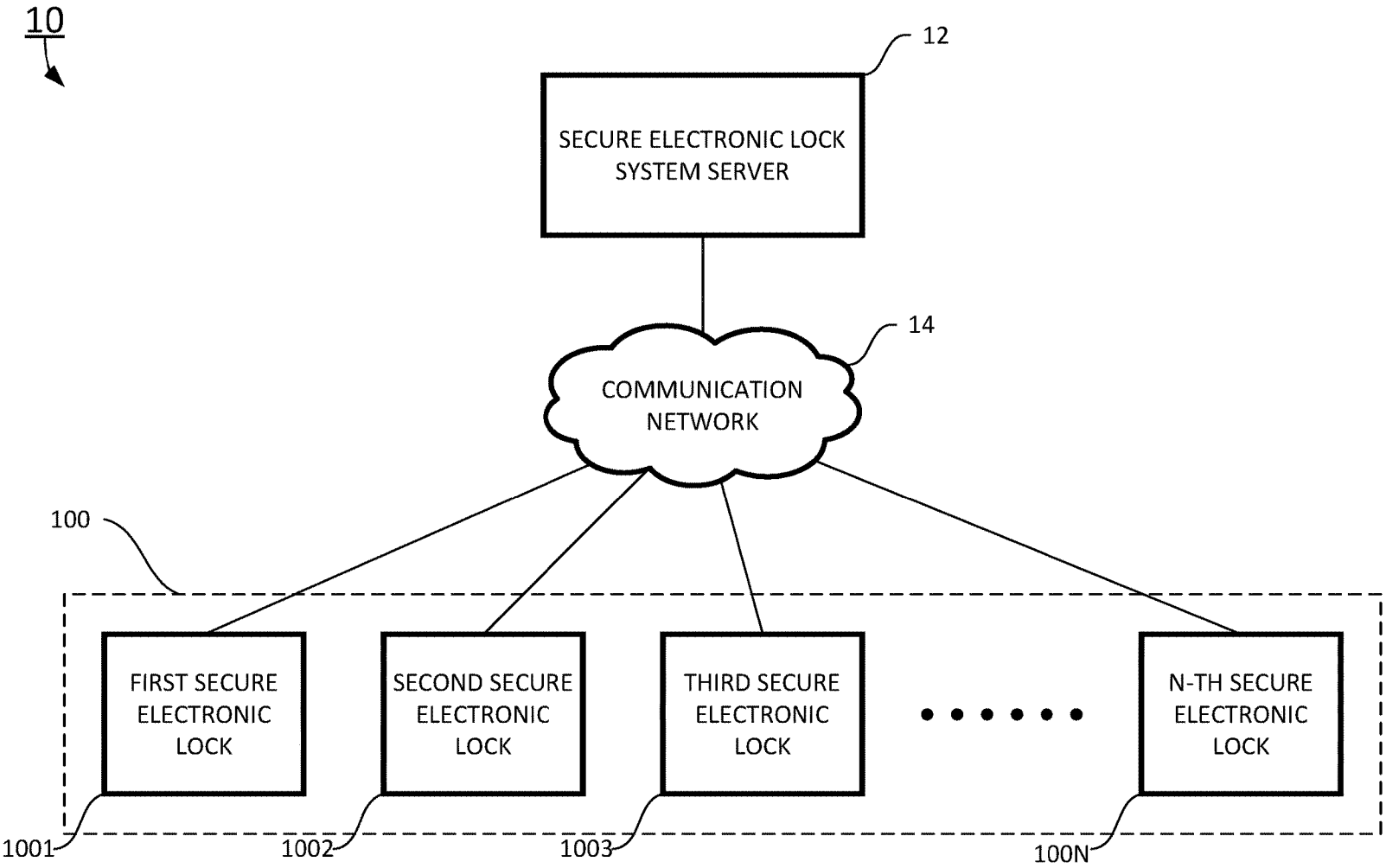
FIG. 1 is a block diagram illustrating a secure electronic lock system according to certain embodiments of the present disclosure.

The present disclosure is more particularly described in the following examples that are intended as illustrative only since numerous modifications and variations therein will be apparent to those skilled in the art. Various embodiments of the disclosure are now described in detail. Referring to the drawings, like numbers, if any, indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present disclosure. Additionally, some terms used in this specification are more specifically defined below.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the disclosure or of any exemplified term. Likewise, the disclosure is not limited to various embodiments given in this specification.

Unless otherwise defined, all technical and scientific terms used herein have the same meaning as commonly understood by one of ordinary skill in the art to which this disclosure pertains. In the case of conflict, the present document, including definitions will control.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, "plurality" means two or more.

As used herein, the terms "comprising," "including," "carrying," "having," "containing," "involving," and the like are to be understood to be open-ended, i.e., to mean including but not limited to.

Figure 8:
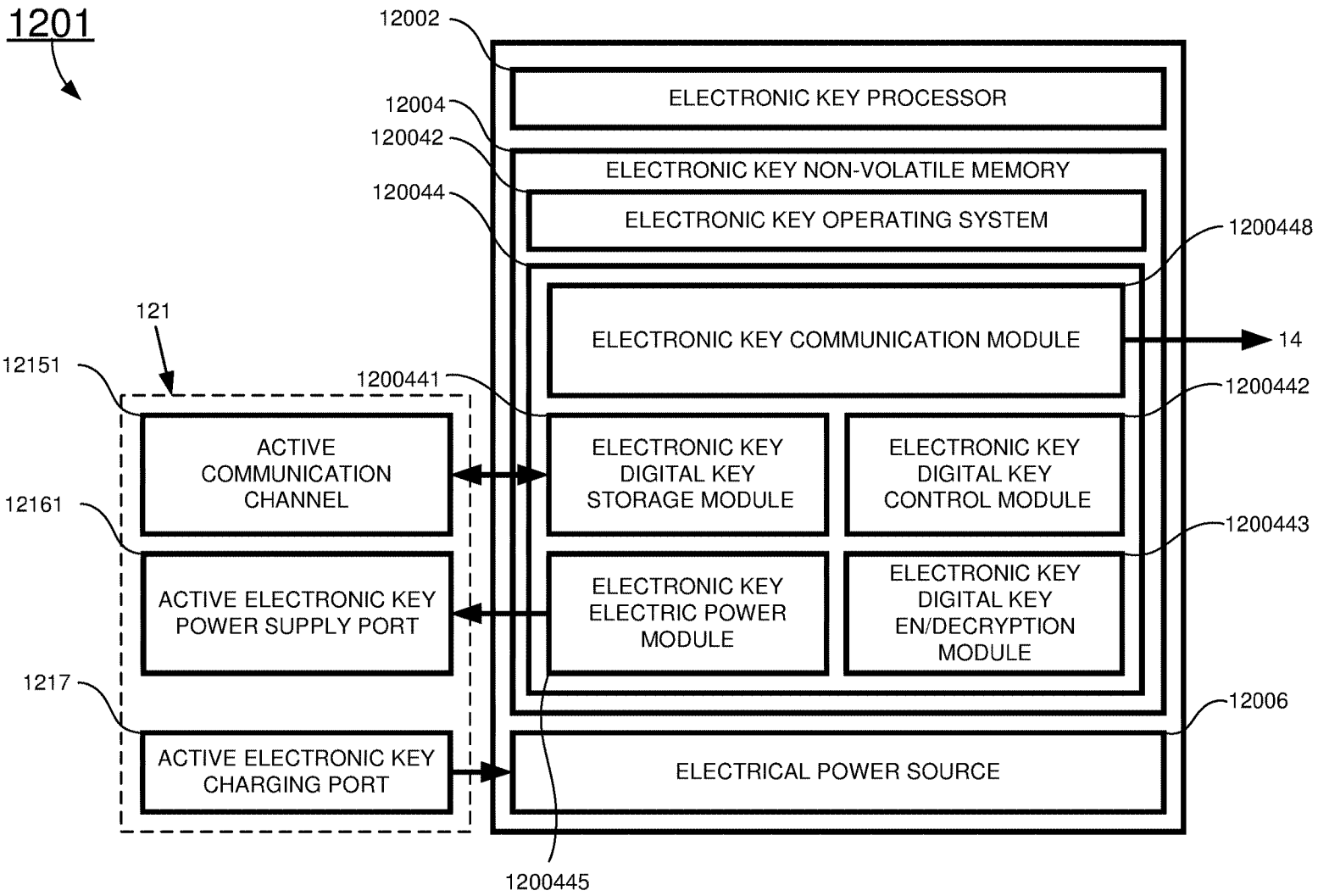
FIG. 8 is a block diagram of an exemplary active electronic key having an electronic key communication module according to one embodiment of the present disclosure.
Figure 9:
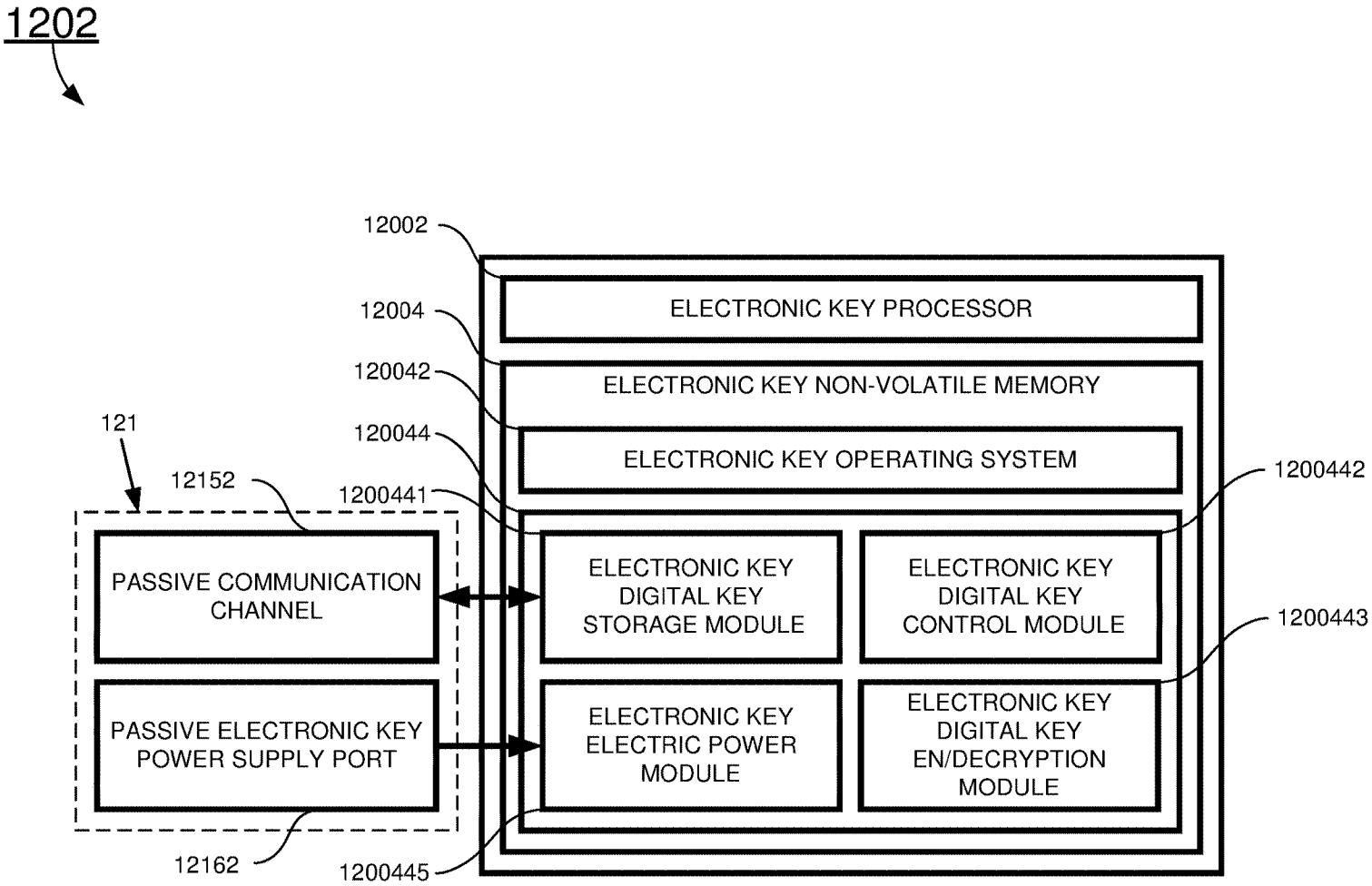
FIG. 9 is block diagram of an exemplary passive electronic key according to certain embodiments of the present disclosure.
Figure 11:
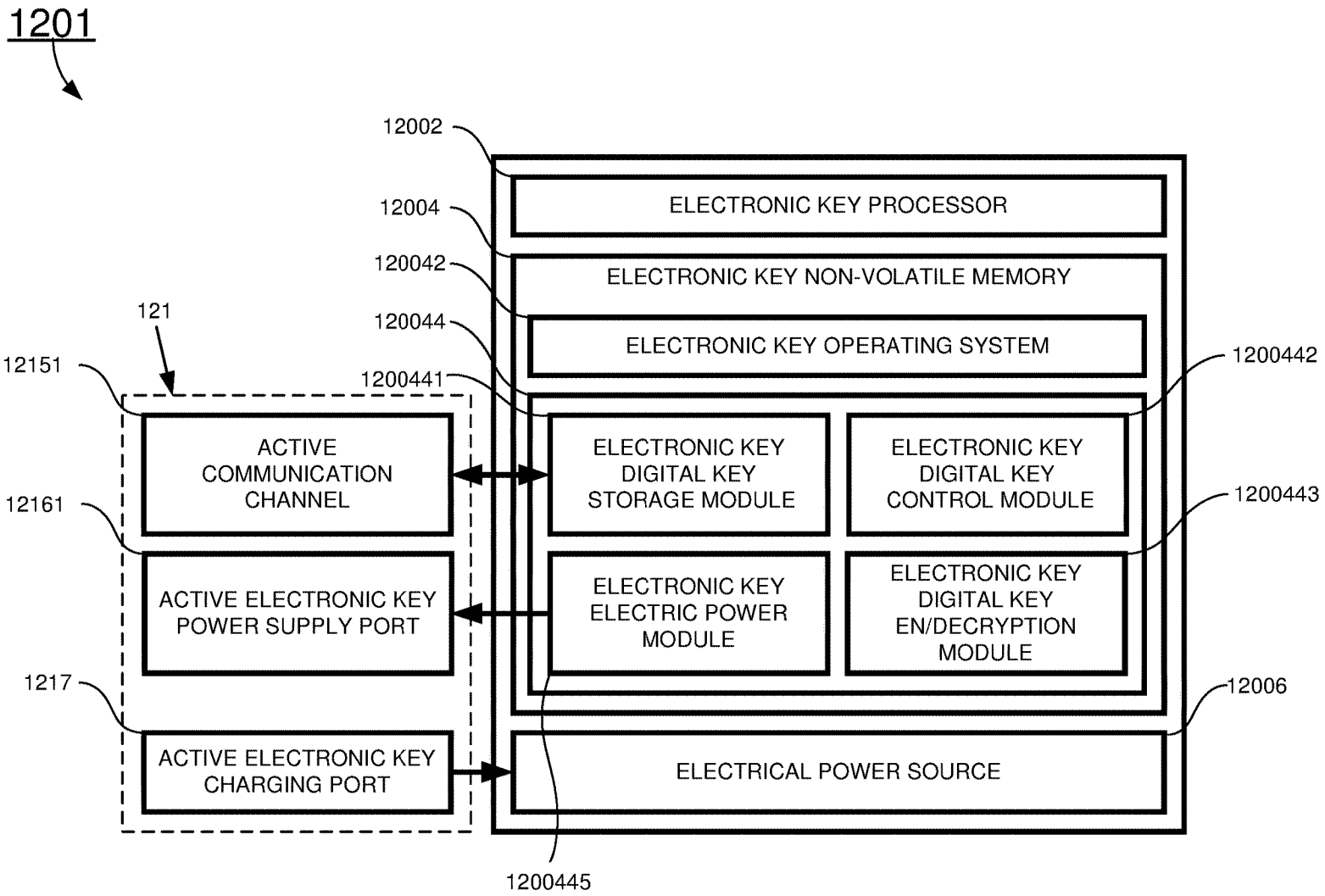
FIG. 11 is a block diagram of an exemplary active electronic key according to another embodiment of the present disclosure.

As used herein, the term electronic key is defined as a physical key to electronically operate an electronic lock. The electronic key may include electronic circuit, electronic modules, electronic key processor, memory, as well many other electronic components. The electronic key may include active electronic key and passive electronic key. The active electronic key includes electrical power source, as shown in FIG. 8 and FIG. 11, and the passive electronic key does not have electrical power source, as shown in FIG. 9.

As used herein, the term digital key is defined as a digital code stored in the physical electronic key to electronically operate the electronic lock. The active electronic key may store an active digital key, and the passive electronic key may store a passive digital key. In order to increase security of the electronic lock, these digital keys may be encrypted during the transmission of the digital keys between the electronic keys and the electronic lock.

As used herein, the phrase at least one of A, B, and C should be construed to mean a logical (A or B or C), using a non-exclusive logical OR. It should be understood that one or more steps within a method may be executed in different order (or conconventionally) without altering the principles of the present disclosure.

As used herein, the term module may refer to, be part of, or include an Application Specific Integrated Circuit (ASIC); an electronic circuit; a combinational logic circuit; a field programmable gate array (FPGA); an electronic key processor (shared, dedicated, or group) that executes code; other suitable hardware components that provide the described functionality; or a combination of some or all of the above, such as in a system-on-chip. The term module may include memory (shared, dedicated, or group) that stores code executed by the electronic key processor.

The term code, as used above, may include software, firmware, and/or microcode, and may refer to programs, routines, functions, classes, and/or objects. The term shared, as used above, means that some or all code from multiple modules may be executed using a single (shared) electronic key processor. In addition, some or all code from multiple modules may be stored by a single (shared) memory. The term group, as used above, means that some or all code from a single module may be executed using a group of electronic key processors. In addition, some or all code from a single module may be stored using a group of memories.

The apparatuses and methods described herein may be implemented by one or more computer programs executed by one or more electronic key processors. The computer programs include electronic key processor-executable instructions that are stored on a non-transitory tangible computer readable medium. The computer programs may also include stored data. Non-limiting examples of the non-transitory tangible computer readable medium are non-volatile memory, magnetic storage, and optical storage.

The present disclosure will now be described more fully hereinafter with reference to the accompanying drawings, in which embodiments of the disclosure are shown. This disclosure may, however, be embodied in many different forms and should not be construed as limited to the embodiments set forth herein; rather, these embodiments are provided so that this disclosure will be thorough and complete, and will fully convey the scope of the disclosure to those skilled in the art. Like numbers refer to like elements throughout.

The present disclosure relates to a safety electronic lock 100 that includes two enhanced security measures. In one aspect, the active electronic key 1201 used in the security electronic lock 100 includes an electronic key communication module 1200448. In certain embodiments, the electronic key communication module 1200448 transmits an access event of the secure electronic lock 100 to the secure electronic lock system server 12 over the communication network 14 after each time the secure electronic lock 100 is accessed. In one embodiment, as shown in FIG. 8, the electronic key communication module 1200448 is installed on the active electronic key 1201.

Figure 10:
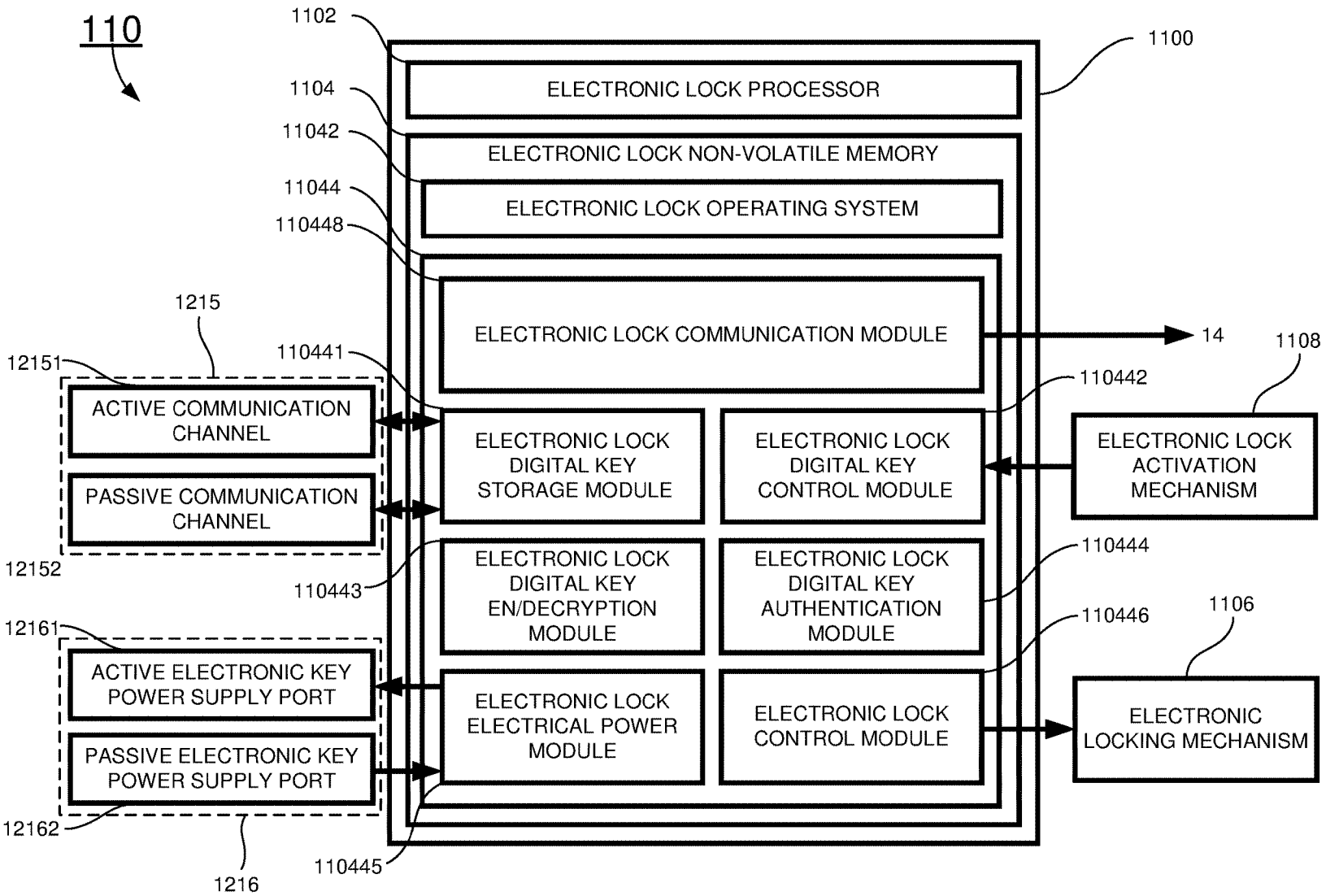
FIG. 10 is a block diagram of an exemplary passive electronic lock having an electronic key communication module according to another embodiment of the present disclosure.

In another aspect, the passive electronic lock 110 of the security electronic lock 100 includes an electronic lock communication module 110448. In certain embodiments, the electronic lock communication module 110448 transmits an access event of the secure electronic lock 100 to the secure electronic lock system server 12 over a communication network 14 after each time the secure electronic lock 100 is accessed. In another embodiment, as shown in FIG. 10, the electronic key communication module 110448 is installed on the passive electronic lock 110.

Figure 2:
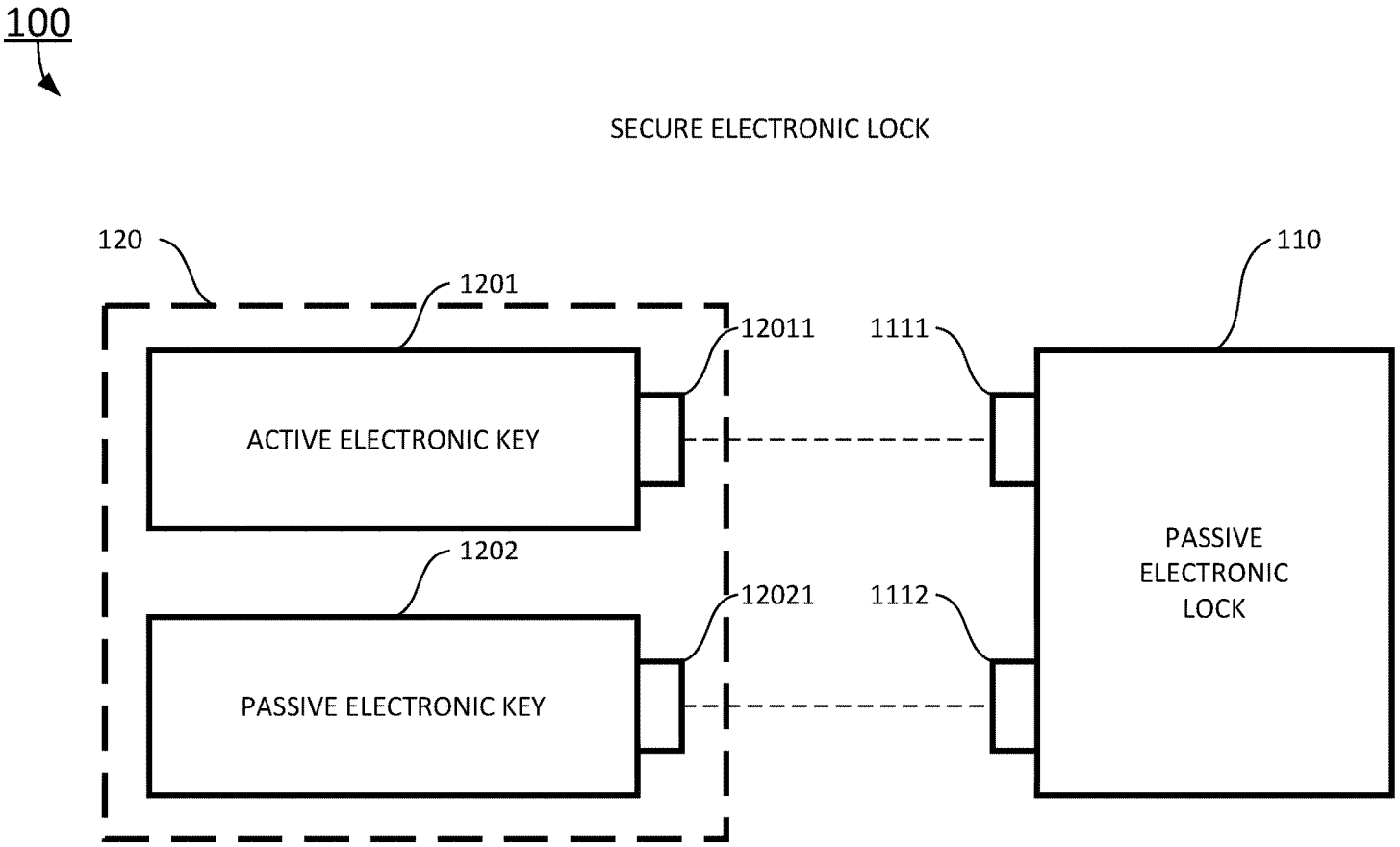
FIG. 2 is a block diagram illustrating a secure electronic lock according to certain embodiments of the present disclosure.

Referring now to FIG. 1, a secure electronic lock system 10 is shown according to certain embodiments of the present disclosure. In certain embodiments, the secure electronic lock system 10 includes a secure electronic lock system server 12, a communication network 14, and many secure electronic locks 100. The secure electronic locks 100 includes N secure electronic locks: a first secure electronic lock 1001, a second secure electronic lock 1002, a third secure electronic lock 1003, . . . and a n-th secure electronic lock 100N. As shown in FIG. 2, each of the secure electronic locks 100 includes: a passive electronic lock 110, an active electronic key 1201, and a passive electronic key 1202.

In certain embodiments, when using the electronic keys 120, as shown in FIG. 2, the active electronic keyhole 1111 of the passive electronic lock 110 is connected to the active electronic key contacts 12011 and the passive electronic keyhole 1112 of the passive electronic lock 110 is connected to the passive electronic key contacts 12021, respectively, so that the power supply 12006 of the active electronic key 1201 provides electrical power supply to the active electronic key 1201, the passive electronic lock 110, and the passive electronic key 1202. Portions of these contacts are used as communication channels for transmission of the corresponding active digital key, passive digital key, as well as a variety of control instructions, among the active electronic key 1201, the passive electronic key 1202, and the passive electronic lock 110.

Figure 3:
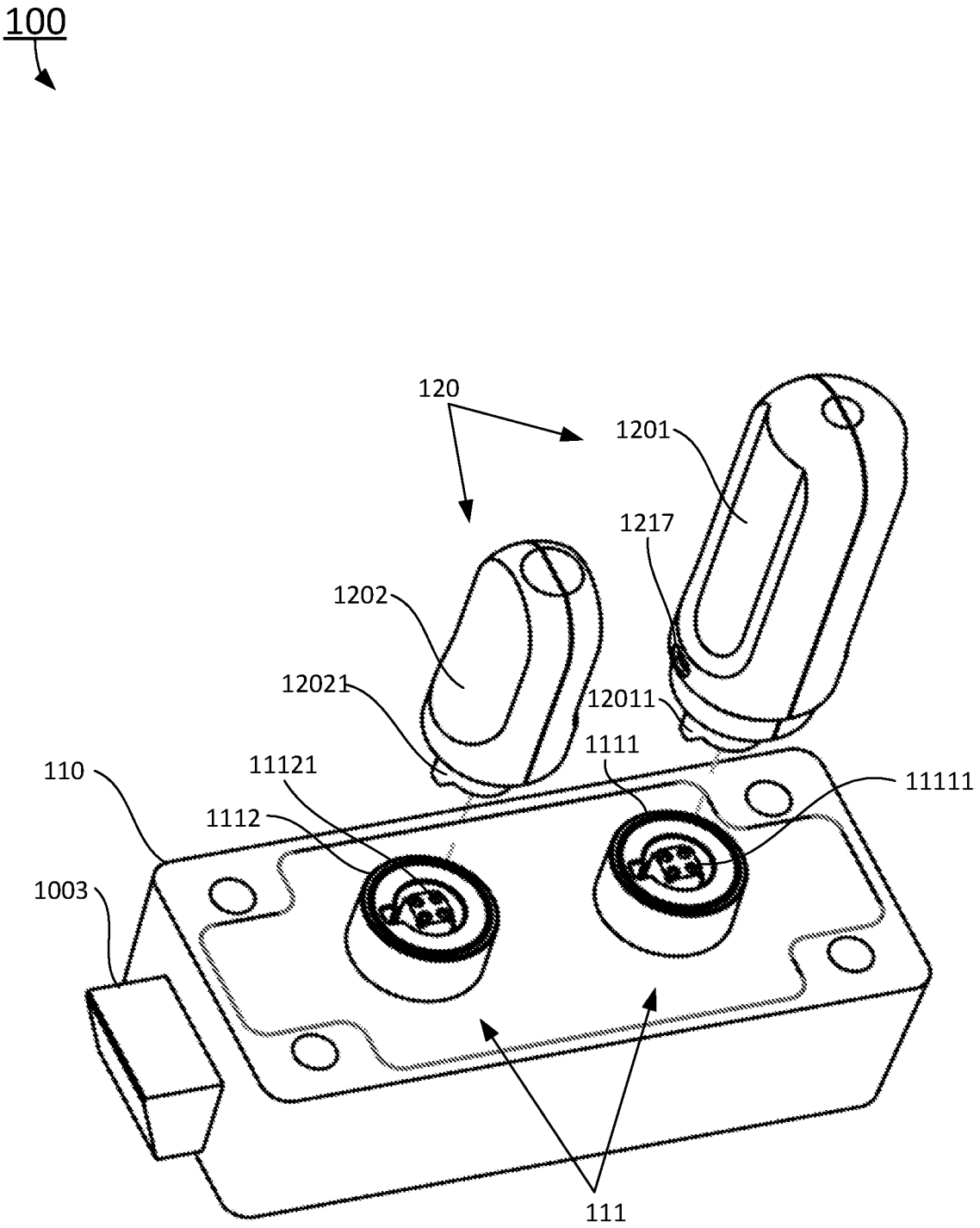
FIG. 3 is a perspective view of the secure electronic lock having an active electronic key, a passive electronic key, and a passive electronic lock, when the active electronic key and the passive electronic key are not inserted into an active electronic keyhole and a passive electronic keyhole of the passive electronic lock, respectively, according to certain embodiments of the present disclosure.
Figure 5:
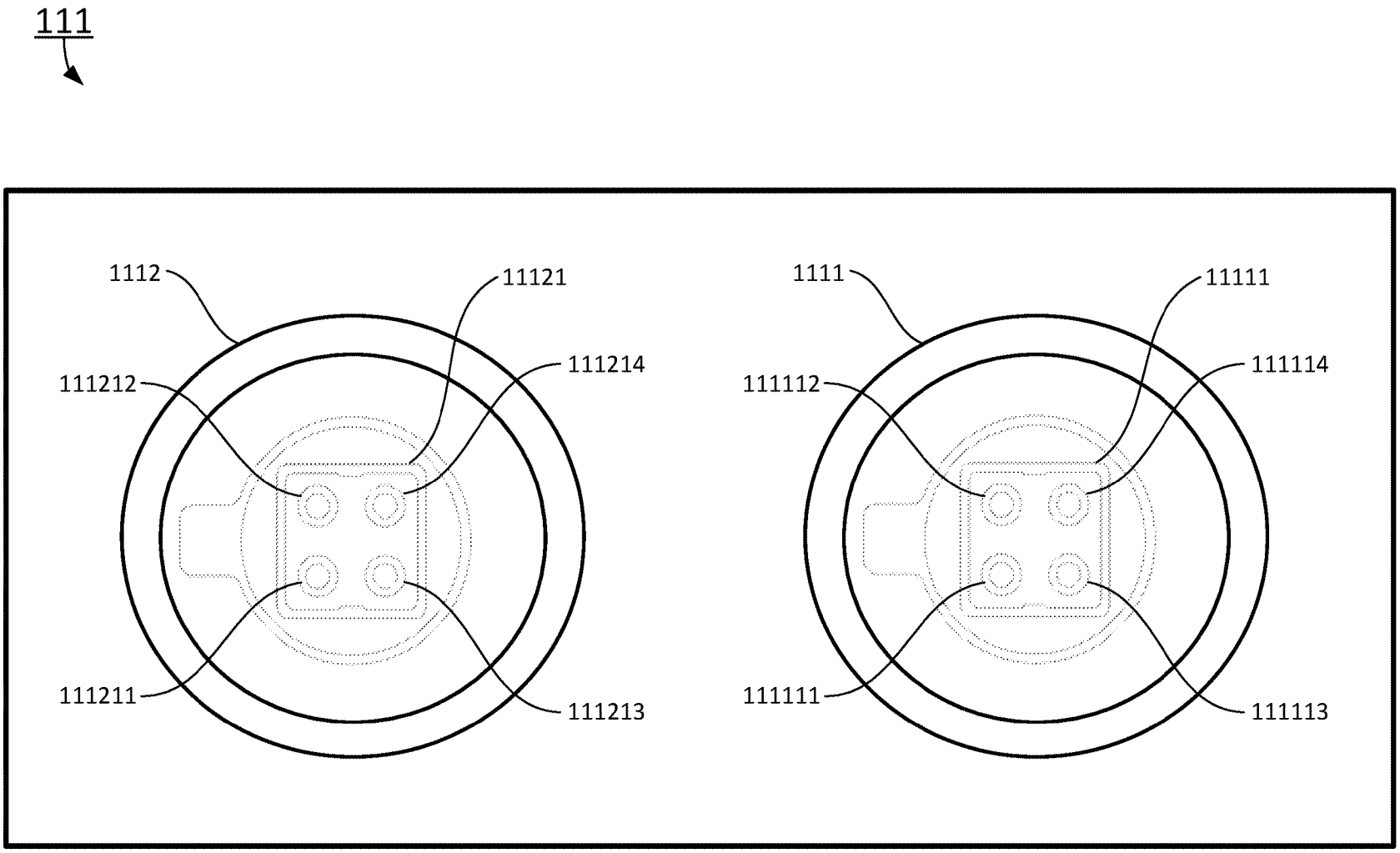
FIG. 5 shows exemplary sets of the active electronic keyhole contacts and the passive electronic keyhole contacts of the passive electronic lock as shown in FIGS. 3 and 4 according to certain embodiments of the present disclosure.

In certain embodiments, as shown in FIG. 3, a perspective view of the secure electronic lock 100 is shown when the active electronic key 1201 and the passive electronic key 1202 are not inserted into an active electronic keyhole 1111 and a passive electronic keyhole 1112 of the passive electronic lock 110, respectively. FIG. 5 shows exemplary sets of the active electronic keyhole contacts 11111 and the passive electronic keyhole contacts 11121 of the passive electronic lock 110 as shown in FIG. 3 according to certain embodiments of the present disclosure.

In certain embodiments, the active electronic keyhole 1111 includes at least two active electronic keyhole contacts 11111 and the active electronic keyhole 1111 receives the active electronic key 1201. The passive electronic keyhole 1202 includes at least two passive electronic keyhole contacts 11121 and the passive electronic keyhole 1202 receives the passive electronic key 1202. These electronic keyhole contacts 11111 and 11121 are used to provide electrical power supply and transmit digital keys between the electronic keys 120 and the passive electronic lock 110. In certain embodiments, the electronic keyhole contacts 111 include at least two electronic key contacts. In one embodiment, the active electronic keyhole 1111 of the passive electronic lock 110 has two active electronic keyhole contacts 11111, and the passive electronic keyhole 1202 of the passive electronic lock 110 has two passive electronic keyhole contacts 11121. For a passive electronic lock 110 having two electronic keyhole contacts, one electronic keyhole contact may be used as positive power supply, and another electronic keyhole contact may be used as ground. These two electronic keyhole contacts may also be used as communication channel.

In another embodiment, the electronic keyhole contacts 101 include three electronic key contacts. For a passive electronic lock 110 having three electronic keyhole contacts, one electronic keyhole contact may be used as positive power supply, another electronic keyhole contact may be used as common ground, and another electronic keyhole contact may be used as communication channel along with the common ground.

In yet another embodiment, as shown in FIG. 5, the active electronic keyhole contacts 11111 include four contacts: a first active electronic keyhole contact 111111, a second active electronic keyhole contact 111112, a third active electronic keyhole contact 111113, and a fourth active electronic keyhole contact 111114. The passive electronic keyhole contacts 11121 include four contacts: a first passive electronic keyhole contact 111211, a second passive electronic keyhole contact 111212, a third passive electronic keyhole contact 111213, and a fourth passive electronic keyhole contact 111214. In this case, the first active electronic keyhole contact 111111 and the second active electronic keyhole contact 111112, as well as first passive electronic keyhole contact 111211 and the second passive electronic keyhole contact 111212 may be used for electrical power supply. The third active electronic keyhole contact 111113 and the fourth active electronic keyhole contact 111114, as well as the third passive electronic keyhole contact 111213 and the fourth passive electronic keyhole contact 111214 may be used as communication channel. Additional electronic keyhole contacts may be included to add other functionalities.

Figure 4:
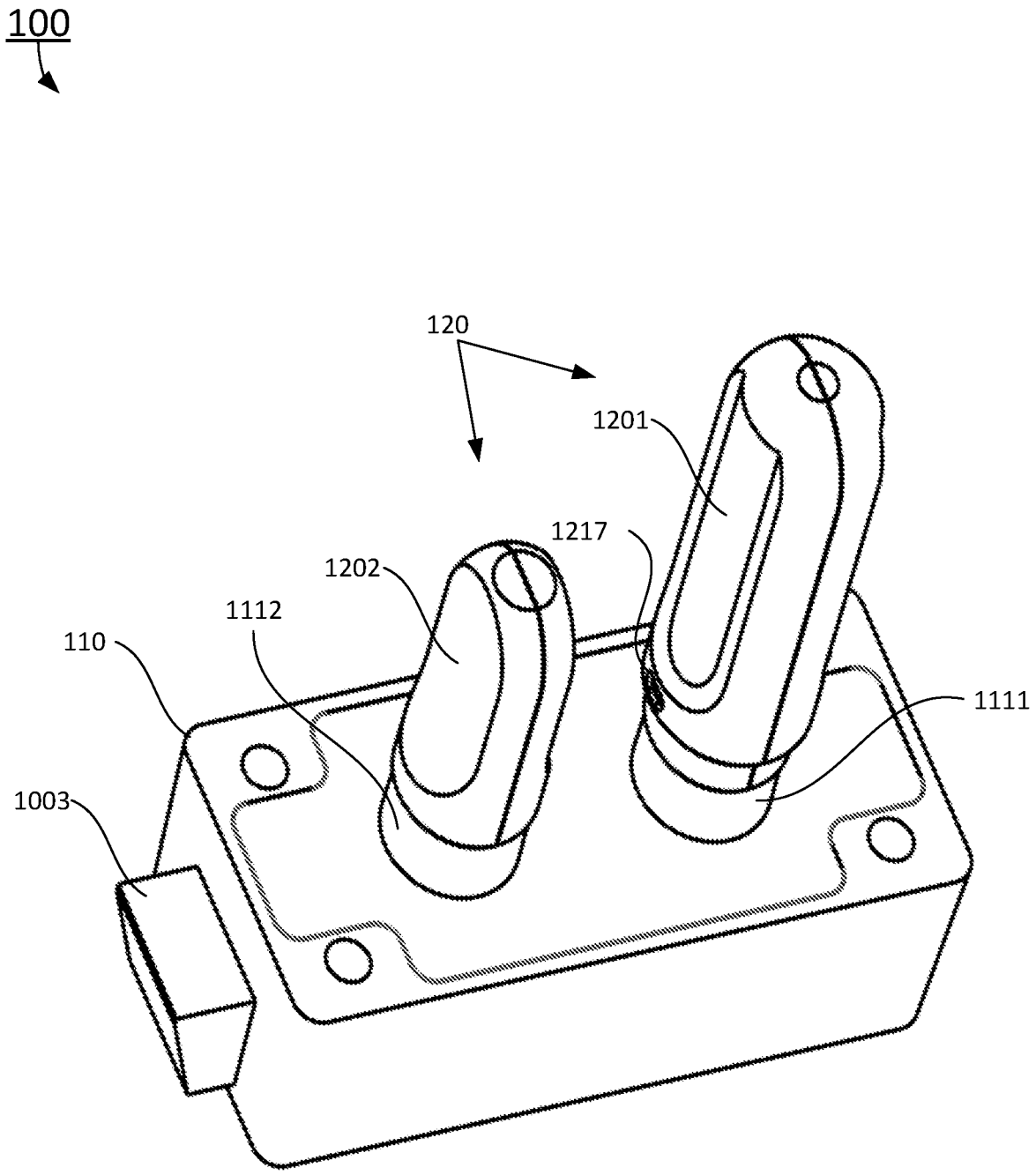
FIG. 4 is a perspective view of the secure electronic lock when the active electronic key and the passive electronic key are inserted into the active electronic keyhole and the passive electronic keyhole of the passive electronic lock, respectively, according to certain embodiments of the present disclosure.

In certain embodiments, FIG. 4 shows a perspective view of the secure electronic lock 100 when the active electronic key 1201 and the passive electronic key 1202 are inserted into the active electronic keyhole 1111 and the passive electronic keyhole 1112 of the passive electronic lock 110, respectively.

Figure 6:
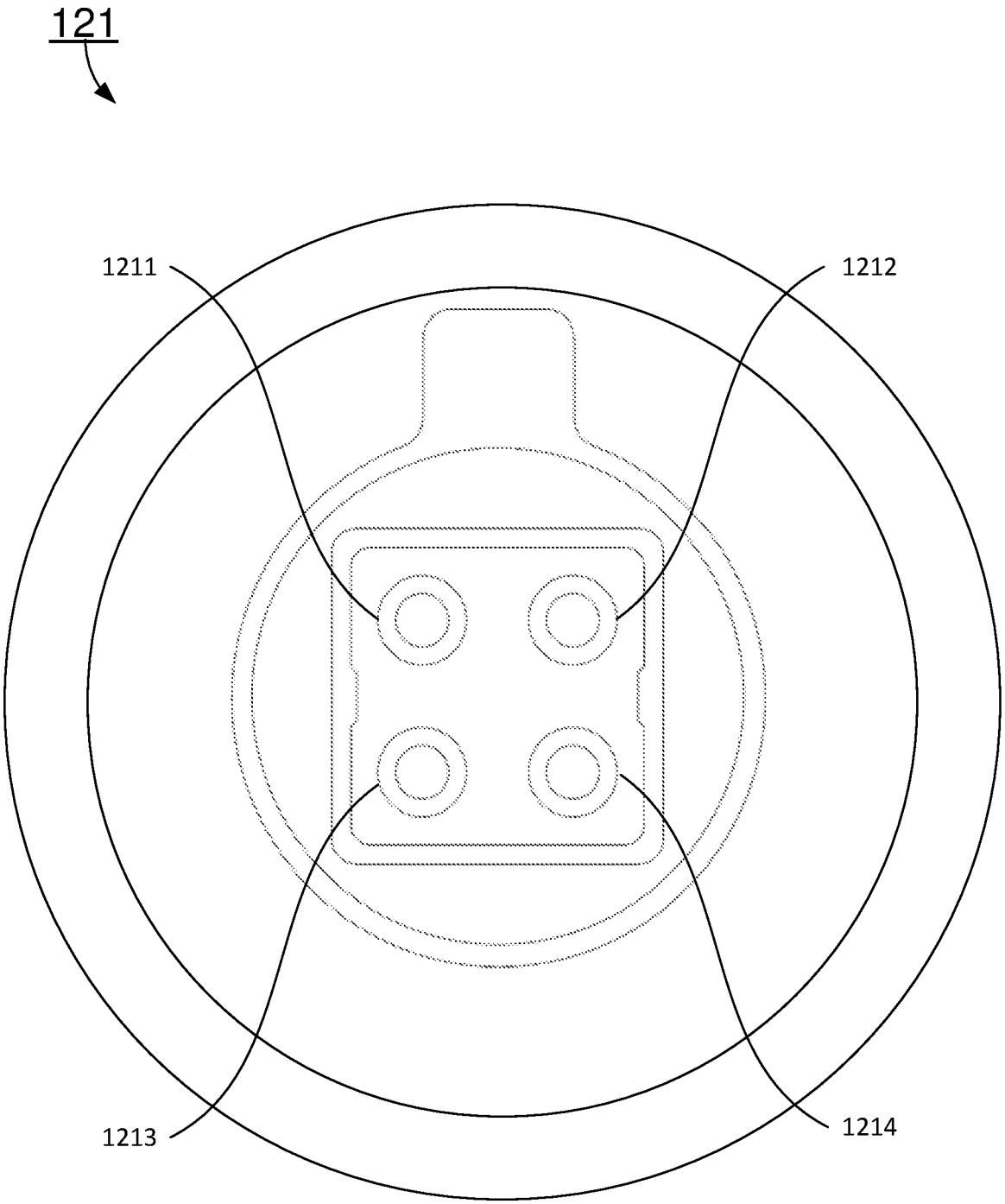
FIG. 6 shows a set of electronic key contacts of an exemplary electronic key according to certain embodiments of the present disclosure.

Each of the active electronic key 1201 and the passive electronic key 1202 includes two or more electronic key contacts 121 that match the electronic keyholes 111 on the passive electronic lock 110. These electronic key contacts 121 are used to provide electrical power supply and transmit digital keys between the electronic keys 120 and the passive electronic lock 110. In certain embodiments, the electronic key contacts 121 include at least two electronic key contacts. In one embodiment, for an electronic key having two electronic key contacts, one electronic key contact may be used as positive power supply, one electronic key contact may be used as ground. These two electronic key contacts may also be used as communication channel. In another embodiment, for an electronic key having three electronic key contacts, one electronic key contact may be used as positive power supply, another one electronic key contact may be used as common ground, and another electronic key contact may be used as communication channel along with the common ground. In one embodiment, as shown in FIG. 6, the electronic key contacts 121 include four contacts: a first electronic key contact 1211, a second electronic key contact 1212, a third electronic key contact 1213, and a fourth electronic key contact 1214. In this embodiment, the first electronic key contact 1211 and the second electronic key contact 1212 may be used for electrical power supply, and the third electronic key contact 1213 and the fourth electronic key contact 1214 may be used as communication channel. Additional electronic key contacts may be included to add other functionalities.

In order to provide higher security, the secure electronic lock 100 includes an electronic key communication module. The electronic key communication module is used to transmit an access event to the secure electronic lock system server after each time the secure electronic lock 100 is accessed. There will be a permanent record of all access events of the secure electronic locks 100 stored in the secure electronic lock system server 12. Each access event may include at least: a serial number of the passive electronic lock 110, a serial number of the active electronic key 1201, the serial number of the passive electronic key 1202, the location, the date and time of each access to the secure electronic lock 100.

In one aspect, the present disclosure relates to a secure electronic lock 100. In certain embodiments, the secure electronic lock 100 includes a passive electronic lock 110 and a set of electronic keys 120. The set of electronic keys 120 includes an active electronic key 1201 and at least a passive electronic key 1202. The active electronic key 1201 stores an active digital key and the passive electronic key 1202 stores a passive digital key. As shown in FIG. 8, the active electronic key 1201 includes an electrical power source 12006, and an electronic key communication module 1200448. The electrical power source 12006 provides electrical power supply to the active electronic key 1201, the passive electronic lock 110 and the passive electronic key 1202. In certain embodiments, the electronic key communication module 1200448 transmits an access event of the secure electronic lock 100 to a secure electronic lock system server 12 over a communication network 14 after each time the secure electronic lock 100 is accessed.

Figure 7:
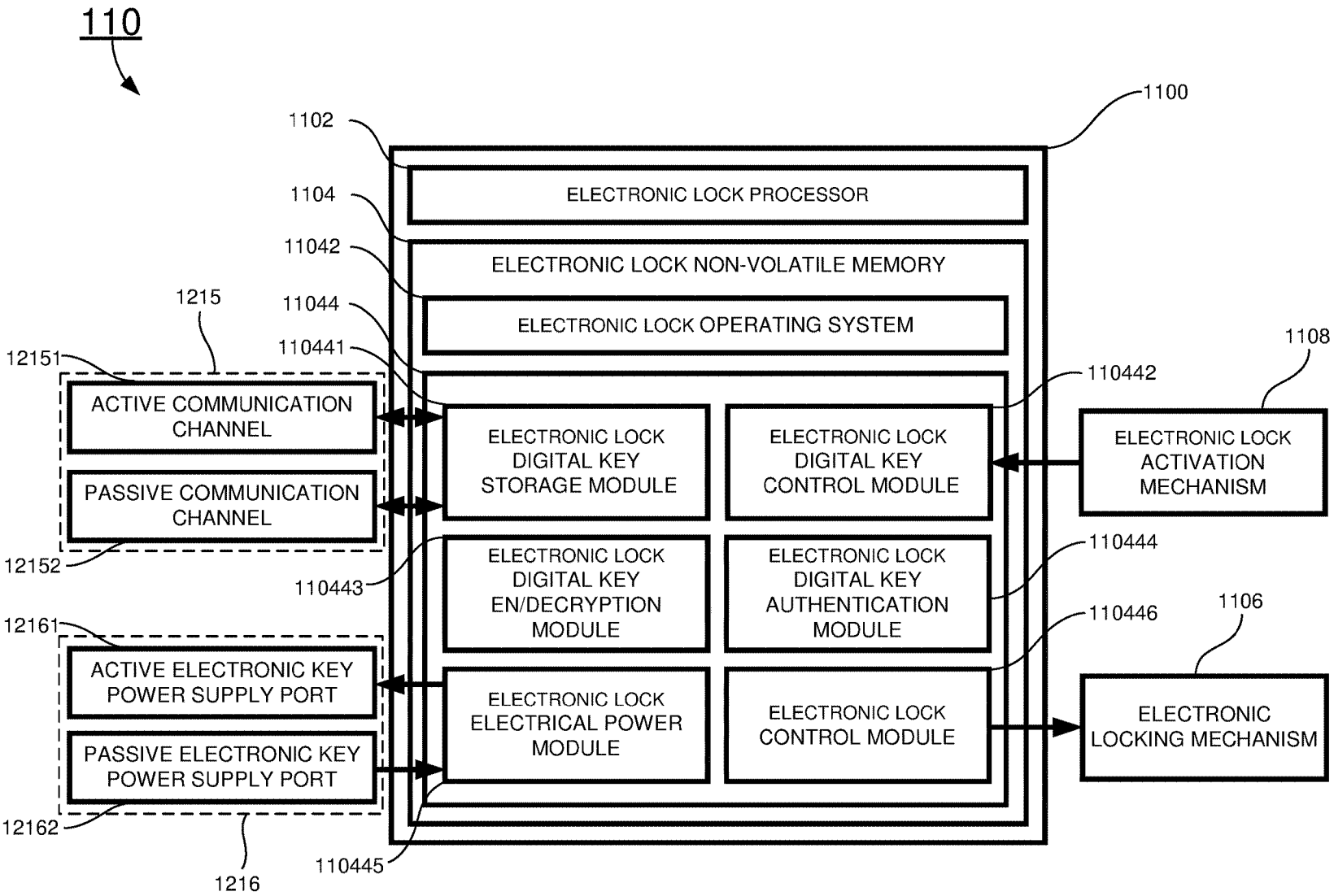
FIG. 7 is a block diagram of an exemplary passive electronic lock according to one embodiment of the present disclosure.

In certain embodiments, the passive electronic lock 110 includes: a set of electronic keyholes 111 and an electronic lock controller 1100. The set of electronic keyholes 111 includes an active electronic keyhole 1111 to receive the active electronic key 1201 and a passive electronic keyhole 1112 to receive the passive electronic key 1202, as shown in FIGS. 3-5. As shown in FIG. 7, the electronic lock controller 1100 includes an electronic lock processor 1102, and an electronic lock non-volatile memory 1104. The electronic lock non-volatile memory 1104 stores an electronic lock operating system 11042 and electronic lock computer executable instructions 11044. The electronic lock computer executable instructions 11044 include: an electronic lock digital key storage module 110441, an electronic lock digital key control module 110442, an electronic lock digital key encryption/decryption module 110443, an electronic lock digital key authentication module 110444, an electronic lock electrical power module 110445, an electronic lock control module 110446.

In certain embodiments, the electronic lock digital key storage module 110441 receives the active digital key from the active electronic key 1201 and the passive digital key from the passive electronic key 1202 generated during an activation process of the secure electronic lock 100, and stores the active digital key and the passive digital key received in the electronic lock digital key storage module 110441 of the passive electronic lock 110 as the active digital key and the passive digital key prestored in the electronic lock digital key storage module 110441 of the passive electronic lock 110 for authentication of the active electronic key 1201 and the passive electronic key 1202, respectively.

In certain embodiments, the electronic lock digital key control module 110442 receives the active digital key when the active electronic key 1201 is inserted in the active electronic keyhole 1111 and the passive digital key when the passive electronic key 1202 is inserted in the passive electronic keyhole 1112, and compares the active digital key and the passive digital key received with the active digital key and the passive digital key prestored in the electronic lock digital key storage module 110441 of the passive electronic lock 110.

In certain embodiments, the electronic lock digital key encryption/decryption module 110443 decrypts the active digital key and the passive digital key received. The electronic lock digital key authentication module 110444 determines whether the active digital key and the passive digital key received match the active digital key and the passive digital key prestored in the electronic lock digital key storage module 110441 of the passive electronic lock 110.

In certain embodiments, the electronic key digital key encryption/decryption module 110443 of the passive electronic lock 110 decrypts the active digital key received and the passive digital key received. In certain embodiments, encryption algorithms may include Triple Data Encryption Standard (DES) algorithm, Rivest-Shamir-Adleman (RSA) algorithm, Blowfish algorithm, Twofish algorithm, and Advanced Encryption Standard (AES) algorithm. One to three private keys may be used for these encryption algorithms and the length of each private key ranges from 56 bits to 256 bits.

In certain embodiments, the electronic lock electrical power module 110445 receives electrical power supply from the electrical power source 12006 of the active electronic key 1201 through the active electronic key power supply port 12161 and provides electrical power supply to the passive electronic key 1202 through the passive electronic key power supply port 12162. The electronic lock control module 110446 controls the operation of the electronic locking mechanism 1106 to lock and unlock the passive electronic lock 110.

In certain embodiments, when executed by the electronic lock processor 1102, the electronic lock computer executable instructions 11044 cause the electronic lock processor 1102 to perform one or more of the following operations:

receiving, via the electronic lock electrical power module 110445, electrical power from an active electronic key power supply port 12161 of the electronic lock controller 1100 from the electrical power source 12006 of the active electronic key 1201, when a first user inserts the active electronic key 1201 into the active electronic keyhole 1111;

providing, via the electronic lock electrical power module 110445, electrical power to the passive electronic key 1202 through a passive electronic key power supply port 12162 of the electronic lock controller 1100, when a second user inserts the passive electronic key 1202 into the passive electronic keyhole 1112;

receiving an encrypted active digital key from the active electronic key 1201 via an active communication channel 12151 of the electronic lock controller 1100, and an encrypted passive digital key from the passive electronic key 1202 via a passive communication channel 12152 of the electronic lock controller 1100, respectively;

decrypting, by an electronic lock digital key encryption/decryption module 110443 of the passive electronic lock 110, the received encrypted active digital key from the active electronic key 1201 and the received encrypted passive digital key from the passive electronic key 1202, and comparing, by an electronic lock digital key control module 110442 of the passive electronic lock 110, the decrypted active digital key and the decrypted passive digital key received with an active digital key and a passive digital key prestored in an electronic lock digital key storage module 110441 of the passive electronic lock 110;

operate, by the electronic lock control module 110446 through an electronic locking mechanism 1106, an electronic lock tongue 1003 to lock or unlock the passive electronic lock 110, when the electronic lock digital key authentication module 110444 determines that the active digital key and the passive digital key received match the active digital key and the passive digital key prestored in the electronic lock digital key storage module 110441 of the passive electronic lock 110, respectively; and transmitting, via the electronic key communication module 1200448, an access event of the secure electronic lock 100 to the secure electronic lock system server 12 over the communication network 14 after each time the secure electronic lock 100 is accessed.

In certain embodiments, the communication network 14 includes at least one of a Wi-Fi network, a Bluetooth network, an infrared network, a Zigbee network, a wireless local area network (WLAN), a wireless metropolitan area network (WMAN), a wireless wide area network (WWAN), a cellular network, and a mobile communication network.

In certain embodiments, the secure electronic lock system server 12 may include a secure electronic lock system database. The secure electronic lock system database may include an inventory of all secure electronic locks 100 as well as the access event logs.

In certain embodiments, when the active electronic key 1201 is inserted into the active electronic keyhole 1111 and the passive electronic key 1202 is inserted into the passive electronic keyhole 1112, respectively, the active digital key from the active electronic key 1201 is encrypted by the electronic key digital key encryption/decryption module 1200443 of the active electronic key 1201 and transmitted to the passive electronic lock 110. The passive digital key from the passive electronic key 1202 is encrypted by the electronic key digital key encryption/decryption module 1200443 of the passive electronic key 1202 and transmitted to the passive electronic lock 110.

In certain embodiments, during an activation process of the secure electronic lock 100, the first user triggers an electronic lock activation mechanism 1108 of the passive electronic lock 110, the electronic lock digital key control module 110442 of the passive electronic lock 110 sends an activation instruction to the active electronic key 1201 and the passive electronic key 1202 through the active communication channel 12151 and the passive communication channel 12152, respectively. The activation instruction instructs the electronic key digital key control module 1200442 of the active electronic key 1201 to generate an active digital key for the active electronic key 1201 and the electronic key digital key control module 1200442 of the passive electronic key 1202 to generate a passive digital key for the passive electronic key 1202. The active digital key generated is stored in the electronic key digital key storage module 1200441 of the active electronic key 1201 and the passive digital key generated is stored in the electronic key digital key storage module 1200441 of the passive electronic key 1202. The active digital key generated is encrypted by the electronic key digital key encryption/decryption module 1200443 of the active electronic key 1201 and transmitted to the electronic lock digital key storage module 110441 as the active digital key prestored and the passive digital key generated is encrypted by the electronic key digital key encryption/decryption module 1200443 of the passive electronic key 1202 and transmitted to the electronic lock digital key storage module 110441 as the passive digital key prestored. The active digital key prestored and the passive digital key prestored are used for authentication of the active electronic key 1201 and the passive electronic key 1202, respectively.

In certain embodiments, as shown in FIG. 7, the passive electronic lock 110 includes an electronic lock activation mechanism 108. In one embodiment, the electronic lock activation mechanism 108 is a push button on a side of the passive electronic lock 110. Prior to the activation, the electronic lock is locked. When the passive electronic lock 110 is ready for a new customer, the first user brings an active electronic key 1201 and a passive electronic key 1202 for activation of the passive electronic lock 110. The active electronic key 1201 is for the first user, and the passive electronic key 1202 is for the second user. When the first user inserts the active electronic key 1201 into the active electronic keyhole 1111 of the passive electronic lock 110, and the second user inserts the passive electronic key 1202 into the passive electronic keyhole 1202 of the passive electronic lock 110, the first user presses the push button, the electronic key digital key control module 1200442 of the passive electronic lock 110 sends an activation instruction to the active electronic key 1201 and the passive electronic key 1202 through the active communication channel 12151 and the passive communication channel 12152, respectively. The activation instruction instructs an electronic key digital key control module 1200442 of the active electronic key 1201 to generate an active digital key for the active electronic key 1201 and an electronic key digital key control module 1200442 of the passive electronic key 1202 to generate a passive digital key for the passive electronic key 1202. The active digital key generated is stored in an electronic key digital key storage module 1200441 of the active electronic key 1201 and the passive digital key generated is stored in an electronic key digital key storage module 1200441 of the passive electronic key 1202. The active digital key generated is encrypted by an electronic key digital key encryption/decryption module 1200443 of the active electronic key 1201 and transmitted to the electronic lock digital key storage module 110441 as the active digital key prestored, and the passive digital key generated is encrypted by an electronic key digital key encryption/decryption module 1200443 of the passive electronic key 1202 and transmitted to the electronic lock digital key storage module 110441 as the passive digital key prestored. The active digital key prestored and the passive digital key prestored are used for authentication of the active electronic key 1201 and the passive electronic key 1202, respectively.

In certain embodiments, as shown in FIG. 7, the passive electronic lock 110 includes two communication channels 1215 and two electronic key power supply ports 1216. The communication channels 1215 include the active communication channel 12151 for transmitting the active digital key between the active electronic key 1201 and the passive electronic lock 110 and the passive communication channel 12152 for transmitting the passive digital key between the passive electronic key 1202 and the passive electronic lock 110. The electronic key power supply ports 1216 include the active electronic key power supply port 12161 for receiving electrical power supply from the active electronic key 1201 and the passive electronic key power supply port 12162 for providing electrical power supply to the passive electronic key 1202 from the active electronic key 1201 through the passive electronic lock 110.

In certain embodiments, as shown in FIG. 8 and FIG. 9, each of the active electronic key 1201 and the passive electronic key 1202 includes: an electronic key processor 12002 and an electronic key non-volatile memory 12004. The electronic key non-volatile memory 12004 stores an electronic key operating system 120042 and electronic key computer executable instructions 120044. The electronic key computer executable instructions 120044 include: an electronic key digital key control module 1200442, the electronic key digital key storage module 1200441, the electronic key digital key encryption/decryption module 1200443, and an electronic key electrical power module 1200445.

In certain embodiments, when executed by the electronic key processor 12002, the electronic key computer executable instructions 120044 cause the electronic key processor 12002 to:

provide, via the electronic key electrical power module 1200445 of the active electronic key 1201, electrical power supply through an active electronic key power supply port 12161 to the passive electronic lock 110, and providing the active digital key to the passive electronic lock 110 through an active communication channel 12151 of the active electronic key 1201, when the first user inserts the active electronic key 1201 into an active electronic keyhole 1111 of the passive electronic lock 110; and provide, via the electronic key electrical power module 1200445 of the active electronic key 1201, electrical power supply to the passive electronic key 1202 through a passive electronic key power supply port 12162 from the passive electronic lock 110, and providing the passive digital key to the passive electronic lock 110 through a passive communication channel 12152 of the passive electronic key 1202, when the active electronic key 1201 is inserted in the active electronic keyhole 1111 of the passive electronic lock 110, and a second user inserts the passive electronic key 1202 into a passive electronic keyhole 1202 of the passive electronic lock 110.

In certain embodiments, the electrical power source 12006 includes at least one of a battery and a rechargeable battery. The rechargeable battery includes at least one of: a lead-acid rechargeable battery, a nickel cadmium (NiCd) rechargeable battery, a nickel metal hydride (NiMH) rechargeable battery, a lithium ion (Li-ion) rechargeable battery, and a lithium ion polymer (Li-ion polymer) rechargeable battery. In certain embodiments, the active electronic key 1201 includes an active electronic key charging port 1217, as shown in FIGS. 3-4, and the active electronic key charging port 1217 is used to charge the rechargeable battery.

In certain embodiments, during an activation process of the secure electronic lock 100, the electronic key digital key control module 1200442 of the active electronic key 1201 generates an active digital key for the active electronic key 1201 and the electronic key digital key control module 1200442 of the passive electronic key 1202 generates a passive digital key for the passive electronic key 1202. The active digital key and the passive digital key generated are first stored in an electronic key digital key storage module 1200441 of the active electronic key 1201 and an electronic key digital key storage module 1200441 of the passive electronic key 1202, respectively. The active digital key and the passive digital key generated are then encrypted using the electronic key digital key encryption/decryption module 1200443 of the active electronic key 1201 and the passive electronic key 1202, respectively, transmitted to and stored in the electronic lock digital key storage module 110441 of the passive electronic lock 110, respectively, for authentication of the active electronic key 1201 and the passive electronic key 1202.

In certain embodiments, the electronic key digital key storage module 1200441 of the active electronic key 1201 receives and stores the active digital key from the electronic key digital key control module 1200442 of the active electronic key 1201 and the electronic key digital key storage module 1200441 of the passive electronic key 1202 receives and stores the passive digital key from the electronic key digital key control module 1200442 of the passive electronic key 1202, respectively.

In certain embodiments, the electronic key digital key encryption/decryption module 1200443 of the active electronic key 1201 encrypts the active digital key before being transmitted out, and the electronic key digital key encryption/decryption module 1200443 of the passive electronic key 1202 encrypts the passive digital key before being transmitted out.

In certain embodiments, the electronic key electrical power module 1200445 of the active electronic key 1201 receives electrical power supply from the electrical power source 12006 and provides electrical power supply to the passive electronic lock 110, and the electronic key electrical power module 1200445 of the passive electronic key 1202 receives electrical power supply from the active electronic key 1201 through the passive electronic lock 110.

In certain embodiments, the passive electronic lock 110 is to be locked and unlocked only when the active electronic key 1201 and the passive electronic key 1202 are simultaneously inserted into the active electronic keyhole 1111 and the passive electronic keyhole 1112, respectively. The first user is a management staff of the secure electronic lock 100 and uses the active electronic key 1201, the second user is a customer and uses the passive electronic key 1202.

In certain embodiments, the active digital key and the passive digital key received are decrypted by the electronic lock digital key encryption/decryption module 110443 of the passive electronic lock 110 and authenticated by the electronic lock digital key control module 110442 of the passive electronic lock 110. When the electronic lock digital key authentication module 110444 determines that the active digital key and the passive digital key received match the active digital key and the passive digital key prestored in the electronic lock digital key storage module 110441 of the passive electronic lock 110, respectively, the electronic lock control module 110446 of the passive electronic lock 110 operates the electronic lock tongue 1003 through the electronic locking mechanism 1106 to lock or unlock the passive electronic lock 110.

In another aspect, as shown in FIG. 1, the present disclosure relates to a secure electronic lock system 10. In certain embodiments, the secure electronic lock system 10 includes: a secure electronic lock system server 12, a communication network 14, and a group of secure electronic locks 100. As shown in FIG. 2, each of the secure electronic locks 100 includes: a passive electronic lock 110 and a set of electronic keys 120. The set of electronic keys 120 includes an active electronic key 1201 storing an active digital key and a passive electronic key 1202 storing a passive digital key. As shown in FIG. 11, the active electronic key 1201 includes an electrical power source 12006. The electrical power source 12006 provides electrical power supply to the active electronic key 1201, the passive electronic lock 110 and the passive electronic key 1202.

In certain embodiments, as shown in FIG. 3, the passive electronic lock 110 includes: a set of electronic keyholes 111 for receiving a set of electronic keys 120, and an electronic lock controller 1100. The set of electronic keyholes 111 includes: an active electronic keyhole 1111 for receiving the active electronic key 1201 and a passive electronic keyhole 1112 for receiving the passive electronic key 1202. As shown in FIG. 10, the electronic lock controller 1100 includes an electronic lock processor 1102, and an electronic lock non-volatile memory 1104 storing an electronic lock operating system 11042 and electronic lock computer executable instructions 11044. The electronic lock computer executable instructions 11044 include: an electronic lock digital key storage module 110441, an electronic lock digital key control module 110442, an electronic lock digital key encryption/decryption module 110443, an electronic lock digital key authentication module 110444, an electronic lock electrical power module 110445, an electronic lock control module 110446, and an electronic lock communication module 110448.

In certain embodiments, the electronic lock digital key storage module 110441 receives the active digital key from the active electronic key 1201 and the passive digital key from the passive electronic key 1202 generated during an activation process of the secure electronic lock 100, and stores the active digital key and the passive digital key received in the electronic lock digital key storage module 110441 of the passive electronic lock 110 as the active digital key and the passive digital key prestored in the electronic lock digital key storage module 110441 of the passive electronic lock 110 for authentication of the active electronic key 1201 and the passive electronic key 1202, respectively.

In certain embodiments, the electronic lock digital key control module 110442 receives the active digital key when the active electronic key 1201 is inserted in the active electronic keyhole 1111 and the passive digital key when the passive electronic key 1202 is inserted in the passive electronic keyhole 1112, and compares the active digital key and the passive digital key received with the active digital key and the passive digital key prestored in the electronic lock digital key storage module 110441 of the passive electronic lock 110.

In certain embodiments, the electronic lock digital key encryption/decryption module 110443 decrypts the active digital key and the passive digital key received. The electronic lock digital key authentication module 110444 determines whether the active digital key and the passive digital key received match the active digital key and the passive digital key prestored in the electronic lock digital key storage module 110441 of the passive electronic lock 110.

In certain embodiments, the electronic lock electrical power module 110445 receives electrical power supply from the electrical power source 12006 of the active electronic key 1201 through the active electronic key power supply port 12161 and provides electrical power supply to the passive electronic key 1202 through the passive electronic key power supply port 12162. The electronic lock control module 110446 controls the operation of the electronic locking mechanism 1106 to lock and unlock the passive electronic lock 110.

In certain embodiments, the electronic lock communication module 110448 transmits an access event of the secure electronic lock 100 to the secure electronic lock system server 12 over the communication network 14 after each time the secure electronic lock 100 is accessed.

In certain embodiments, when executed by the electronic lock processor 1102, the electronic lock computer executable instructions 11044 cause the electronic lock processor 1102 to perform one or more of the following operations:

receiving, via the electronic lock electrical power module 110445, electrical power from an active electronic key power supply port 12161 of the electronic lock controller 1100 from the electrical power source 12006 of the active electronic key 1201, when a first user inserts the active electronic key 1201 into the active electronic keyhole 1111;

providing, via the electronic lock electrical power module 110445, electrical power to the passive electronic key 1202 through a passive electronic key power supply port 12162 of the electronic lock controller 1100, when a second user inserts the passive electronic key 1202 into the passive electronic keyhole 1112;

receiving an encrypted active digital key from the active electronic key 1201 via an active communication channel 12151 of the electronic lock controller 1100, and an encrypted passive digital key from the passive electronic key 1202 via a passive communication channel 12152 of the electronic lock controller 1100, respectively;

decrypting, by an electronic lock digital key encryption/decryption module 110443 of the passive electronic lock 110, the received encrypted active digital key from the active electronic key 1201 and the received encrypted passive digital key from the passive electronic key 1202, and comparing, by an electronic lock digital key control module 110442 of the passive electronic lock 110, the decrypted active digital key and the decrypted passive digital key received with an active digital key and a passive digital key prestored in an electronic lock digital key storage module 110441 of the passive electronic lock 110;

operate, by the electronic lock control module 110446 through an electronic locking mechanism 1106, an electronic lock tongue 1003 to lock or unlock the passive electronic lock 110, when the electronic lock digital key authentication module 110444 determines that the active digital key and the passive digital key received match the active digital key and the passive digital key prestored in the electronic lock digital key storage module 110441 of the passive electronic lock 110, respectively; and transmitting, via the electronic lock communication module 110448, an access event of the secure electronic lock 100 to the secure electronic lock system server 12 over the communication network 14 after each time the secure electronic lock 100 is accessed.

In certain embodiments, when the active electronic key 1201 is inserted into the active electronic keyhole 1111 and the passive electronic key 1202 is inserted into the passive electronic keyhole 1112, respectively, the active digital key from the active electronic key 1201 is encrypted by the electronic key digital key encryption/decryption module 1200443 of the active electronic key 1201 and transmitted to the passive electronic lock 110, and the passive digital key from the passive electronic key 1202 is encrypted by the electronic key digital key encryption/decryption module 1200443 of the passive electronic key 1202 and transmitted to the passive electronic lock 110.

In certain embodiments, during an activation process of the secure electronic lock 100, the first user triggers an electronic lock activation mechanism 1108 of the passive electronic lock 110, the electronic lock digital key control module 110442 of the passive electronic lock 110 sends an activation instruction to the active electronic key 1201 and the passive electronic key 1202 through the active communication channel 12151 and the passive communication channel 12152, respectively. The activation instruction instructs the electronic key digital key control module 1200442 of the active electronic key 1201 to generate an active digital key for the active electronic key 1201 and the electronic key digital key control module 1200442 of the passive electronic key 1202 to generate a passive digital key for the passive electronic key 1202. The active digital key generated is stored in the electronic key digital key storage module 1200441 of the active electronic key 1201 and the passive digital key generated is stored in the electronic key digital key storage module 1200441 of the passive electronic key 1202. The active digital key generated is encrypted by the electronic key digital key encryption/decryption module 1200443 of the active electronic key 1201 and transmitted to the electronic lock digital key storage module 110441 as the active digital key prestored and the passive digital key generated is encrypted by the electronic key digital key encryption/decryption module 1200443 of the passive electronic key 1202 and transmitted to the electronic lock digital key storage module 110441 as the passive digital key prestored. The active digital key prestored and the passive digital key prestored are used for authentication of the active electronic key 1201 and the passive electronic key 1202, respectively.

In certain embodiments, as shown in FIG. 9, and FIG. 11, each of the active electronic key 1201 and the passive electronic key 1202 includes: an electronic key processor 12002 and an electronic key non-volatile memory 12004. The electronic key non-volatile memory 12004 stores an electronic key operating system 120042 and electronic key computer executable instructions 120044. The electronic key computer executable instructions 120044 include: an electronic key digital key control module 1200442, the electronic key digital key storage module 1200441, the electronic key digital key encryption/decryption module 1200443, and an electronic key electrical power module 1200445.

In certain embodiments, when executed by the electronic key processor 12002, the electronic key computer executable instructions 120044 cause the electronic key processor 12002 to:

provide, via the electronic key electrical power module 1200445 of the active electronic key 1201, electrical power supply through an active electronic key power supply port 12161 to the passive electronic lock 110, and providing the active digital key to the passive electronic lock 110 through an active communication channel 12151 of the active electronic key 1201, when the first user inserts the active electronic key 1201 into an active electronic keyhole 1111 of the passive electronic lock 110; and provide, via the electronic key electrical power module 1200445 of the active electronic key 1201, electrical power supply to the passive electronic key 1202 through a passive electronic key power supply port 12162 from the passive electronic lock 110, and providing the passive digital key to the passive electronic lock 110 through a passive communication channel 12152 of the passive electronic key 1202, when the active electronic key 1201 is inserted in the active electronic keyhole 1111 of the passive electronic lock 110, and a second user inserts the passive electronic key 1202 into a passive electronic keyhole 1202 of the passive electronic lock 110.

In certain embodiments, the electrical power source 12006 includes at least one of a battery and a rechargeable battery. The rechargeable battery includes at least one of: a lead-acid rechargeable battery, a nickel cadmium (NiCd) rechargeable battery, a nickel metal hydride (NiMH) rechargeable battery, a lithium ion (Li-ion) rechargeable battery, and a lithium ion polymer (Li-ion polymer) rechargeable battery. In certain embodiments, the active electronic key 1201 includes an active electronic key charging port 1217, as shown in FIGS. 3-4, and the active electronic key charging port 1217 is used to charge the rechargeable battery.

In certain embodiments, during an activation process of the secure electronic lock 100, the electronic key digital key control module 1200442 of the active electronic key 1201 generates an active digital key for the active electronic key 1201 and the electronic key digital key control module 1200442 of the passive electronic key 1202 generates a passive digital key for the passive electronic key 1202. The active digital key and the passive digital key generated are first stored in an electronic key digital key storage module 1200441 of the active electronic key 1201 and an electronic key digital key storage module 1200441 of the passive electronic key 1202, respectively. The active digital key and the passive digital key generated are then encrypted using the electronic key digital key encryption/decryption module 1200443 of the active electronic key 1201 and the passive electronic key 1202, respectively, transmitted to and stored in the electronic lock digital key storage module 110441 of the passive electronic lock 110, respectively, for authentication of the active electronic key 1201 and the passive electronic key 1202.

In certain embodiments, the electronic key digital key storage module 1200441 of the active electronic key 1201 receives and stores the active digital key from the electronic key digital key control module 1200442 of the active electronic key 1201 and the electronic key digital key storage module 1200441 of the passive electronic key 1202 receives and stores the passive digital key from the electronic key digital key control module 1200442 of the passive electronic key 1202, respectively.

In certain embodiments, the electronic key digital key encryption/decryption module 1200443 of the active electronic key 1201 encrypts the active digital key before being transmitted out, and the electronic key digital key encryption/decryption module 1200443 of the passive electronic key 1202 encrypts the passive digital key before being transmitted out. In certain embodiments, encryption algorithms may include Triple Data Encryption Standard (DES) algorithm, Rivest-Shamir-Adleman (RSA) algorithm, Blowfish algorithm, Twofish algorithm, and Advanced Encryption Standard (AES) algorithm. One to three private keys may be used for these encryption algorithms and the length of each private key ranges from 56 bits to 256 bits.

In certain embodiments, the electronic key electrical power module 1200445 of the active electronic key 1201 receives electrical power supply from the electrical power source 12006 and provides electrical power supply to the passive electronic lock 110, and the electronic key electrical power module 1200445 of the passive electronic key 1202 receives electrical power supply from the active electronic key 1201 through the passive electronic lock 110.

In certain embodiments, the passive electronic lock 110 is to be locked and unlocked only when the active electronic key 1201 and the passive electronic key 1202 are simultaneously inserted into the active electronic keyhole 1111 and the passive electronic keyhole 1112, respectively. The first user is a management staff of the secure electronic lock 100 and uses the active electronic key 1201, the second user is a customer and uses the passive electronic key 1202.

In certain embodiments, the active digital key and the passive digital key received are decrypted by the electronic lock digital key encryption/decryption module 110443 of the passive electronic lock 110 and authenticated by the electronic lock digital key control module 110442 of the passive electronic lock 110. When the electronic lock digital key authentication module 110444 determines that the active digital key and the passive digital key received match the active digital key and the passive digital key prestored in the electronic lock digital key storage module 110441 of the passive electronic lock 110, respectively, the electronic lock control module 110446 of the passive electronic lock 110 operates the electronic lock tongue 1003 through the electronic locking mechanism 1106 to lock or unlock the passive electronic lock 110.

In certain embodiments, as shown in FIG. 10, the passive electronic lock 110 includes two communication channels 1215 and two electronic key power supply ports 1216. The communication channels 1215 include the active communication channel 12151 for transmitting the active digital key between the active electronic key 1201 and the passive electronic lock 110 and the passive communication channel 12152 for transmitting the passive digital key between the passive electronic key 1202 and the passive electronic lock 110. The electronic key power supply ports 1216 include the active electronic key power supply port 12161 for receiving electrical power supply from the active electronic key 1201 and the passive electronic key power supply port 12162 for providing electrical power supply to the passive electronic key 1202 from the active electronic key 1201 through the passive electronic lock 110.

In yet another aspect, the present disclosure relates to a method 1200 of using a secure electronic lock system 10. In certain embodiments, the method 1200 includes:

installing the secure electronic lock system 10. The secure electronic lock system 10 includes: a secure electronic lock system server 12, a communication network 14, and many secure electronic locks 100, each of the secure electronic locks 100 is connected to the secure electronic lock system server 12 over the communication network 14. Each of the secure electronic locks 100 includes: an active electronic key 1201, a passive electronic key 1202, and a passive electronic lock 110. The passive electronic lock 110 includes a set of electronic keyholes 111: an active electronic keyhole 1111 for receiving the active electronic key 1201 and a passive electronic keyhole 1112 for receiving the passive electronic key 1202;

inserting, by a first user, the active electronic key 1201 into the active electronic keyhole 1111 of the passive electronic lock 110. The active electronic key 1201 includes an electrical power source 12006 to provide electrical power supply to the passive electronic lock 110 through an active electronic key power supply port 12161 of the active electronic key 1201, and to provide an encrypted active digital key to the passive electronic lock 110 through an active communication channel 12151 of the active electronic key 1201;

while the active electronic key 1201 is inserted in the active electronic keyhole 1111, inserting, by a second user the passive electronic key 1202 into the passive electronic keyhole 1112 of the passive electronic lock 110 to receive electrical power supply from the passive electronic lock 110 through a passive electronic key power supply port 12162 of the passive electronic key 1202, and to provide an encrypted passive digital key to the passive electronic lock 110 through a passive communication channel 12152 of the passive electronic key 1202;

decrypting, by an electronic lock digital key encryption/decryption module 110443 of the passive electronic lock 110, the received encrypted active digital key from the active electronic key 1201 and the received encrypted passive digital key from the passive electronic key 1202, and comparing, by an electronic lock digital key control module 110442 of the passive electronic lock 110, the decrypted active digital key and the decrypted passive digital key received with an active digital key and a passive digital key prestored in an electronic lock digital key storage module 110441 of the passive electronic lock 110;

when an electronic lock digital key authentication module 110444 of the passive electronic lock 110 determines that the active digital key and the passive digital key received match the active digital key and the passive digital key prestored in the electronic lock digital key storage module 110441 of the passive electronic lock 110, respectively, operating, by the electronic lock digital key control module 110442 of the passive electronic lock 110, an electronic lock tongue 1003 of the passive electronic lock 110 through an electronic lock control module 110446 and an electronic locking mechanism 1106 to lock and unlock the passive electronic lock 110; and transmitting, via an electronic lock communication module 110448 of the passive electronic lock 110, an access event of the secure electronic lock 100 to the secure electronic lock system server 12 over the communication network 14 after each time the secure electronic lock 100 is accessed.

Figure 12:
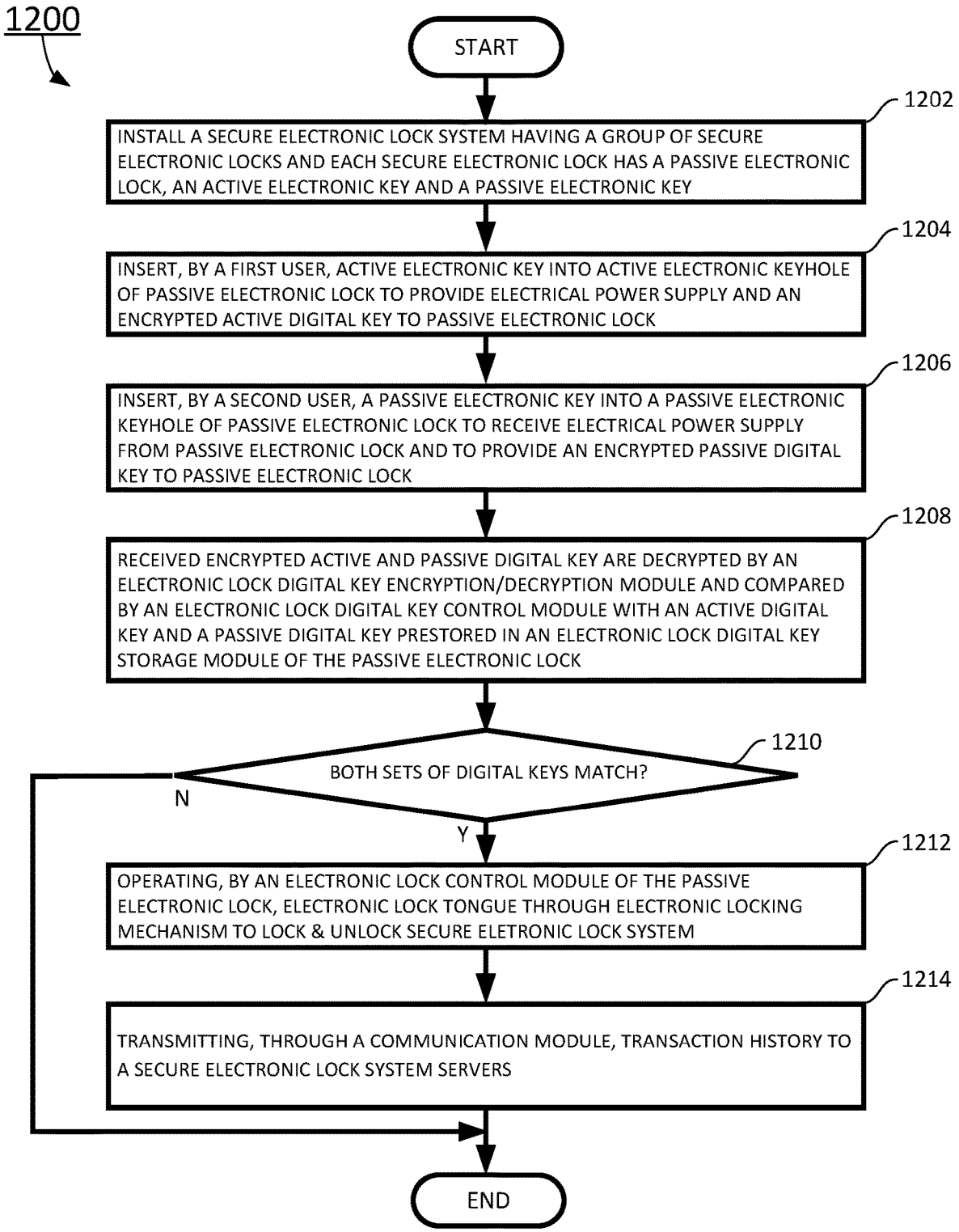
FIG. 12 shows a flowchart of a method of using the secure electronic lock system according to certain embodiments of the present disclosure.

Referring now to FIG. 12, a flowchart of the method 1200 of using the secure electronic lock system 10 to operate one of the secure electronic locks 100 is shown according to certain embodiments of the present disclosure.

At block 1202, the secure electronic lock system 10 is installed. In certain embodiments, the secure electronic lock system 10 includes: a secure electronic lock system server 12, a communication network 14, and many secure electronic locks 100. Each of the secure electronic locks 100 is connected to the secure electronic lock system server 12 over the communication network 14. Each of the secure electronic locks 100 includes: an active electronic key 1201, a passive electronic key 1202, and a passive electronic lock 110. The passive electronic lock 110 includes a set of electronic keyholes 111: an active electronic keyhole 1111 for receiving the active electronic key 1201 and a passive electronic keyhole 1112 for receiving the passive electronic key 1202.

At block 1204, the first user inserts the active electronic key 1201 into the active electronic keyhole 1111 of the passive electronic lock 110. The active electronic key 1201 includes an electrical power source 12006 to provide electrical power supply to the passive electronic lock 110 through an active electronic key power supply port 12161 of the active electronic key 1201. Additionally, the active electronic key 1201 provides an encrypted active digital key to the passive electronic lock 110 through an active communication channel 12151 of the active electronic key 1201. Since the active electronic key 1201 provides electrical power supply to the entire secure electronic lock system 10, the secure electronic lock system 10 will not function without the active electronic key 1201. Customarily, the first user is a bank employee who manages the safety deposit box where the passive electronic lock 110 is installed.

At block 1206, while the active electronic key 1201 is still in the active electronic keyhole 1111 of the passive electronic lock 110, a second user inserts the passive electronic key 1202 into the passive electronic keyhole 1112 of the passive electronic lock 110 to receive electrical power supply from the passive electronic lock 110 through an electronic key electrical power module 1200445 of the passive electronic key 1202 and a passive electronic key power supply port 12162, and the passive electronic key 1202 provides an encrypted passive digital key to the passive electronic lock 110 through a passive communication channel 12152 of the passive electronic key 1202. Since the passive electronic key 1202 does not have electrical power supply, the secure electronic lock system 10 will not function with only the passive electronic key 1202. Customarily, the second user is a customer who rents the safety deposit box where the passive electronic lock 110 is installed.

At block 1208, the received encrypted active digital key from the active electronic key 1201 and the received encrypted passive digital key from the passive electronic key 1202 are decrypted by an electronic lock digital key encryption/decryption module 110443 of the passive electronic lock 110, and the received active digital key and the received passive digital key are compared by an electronic lock digital key control module 110442 of the passive electronic lock 110 with an active digital key and a passive digital key prestored in an electronic lock digital key storage module 110441 of the passive electronic lock 110.

At query block 1210, the electronic lock digital key authentication module 110444 of the passive electronic lock 110 determines whether the active digital key and the passive digital key received match the active digital key and the passive digital key prestored, respectively. When the active digital key and the passive digital key received match the active digital key and the passive digital key prestored, respectively, the method 1200 proceeds to block 1212. Otherwise, the secure electronic lock 100 is not accessed and the method 1200 is terminated.

At block 1212, when the active digital key and the passive digital key received match the active digital key and the passive digital key prestored, respectively, an electronic lock control module 110446 of the passive electronic lock 110 operates an electronic lock tongue 1003 of the passive electronic lock 110 through an electronic locking mechanism 1106 to lock and unlock the passive electronic lock 110. The electronic lock tongue 1003 is in retracted state when the passive electronic lock 110 is unlocked, and the electronic lock tongue 1003 is in extended state when the passive electronic lock 110 is locked.

At block 1214, after the passive electronic lock 110 of the secure electronic lock 100 is accessed, the passive electronic lock 110 will perform two additional functions to increase the security of the secure electronic lock 100: (1) an access event of the secure electronic lock 100 is transmitted through an electronic lock communication module 110448 over the communication network 14 to the secure electronic lock system server 12, and (2) the active digital key stored in the electronic key digital key storage module 1200441 of the active electronic key 1201, the passive digital key stored in the electronic key digital key storage module 1200441 of the passive electronic key 1202, and the active digital key and the passive digital key prestored in the electronic lock digital key storage module 110441 are regenerated and stored in their corresponding storage modules respectively so the old active digital keys and the old passive digital keys are no longer valid even if someone can hack was able to obtain it. There will be a permanent record of all access events of the secure electronic locks 100 stored in the secure electronic lock system server. Each access event may include at least: a serial number of the passive electronic lock 110, a serial number of the active electronic key 1201, the serial number of the passive electronic key 1202, the location, the date and time of each access to the secure electronic lock 100.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope. Accordingly, the scope of the present disclosure is defined by the appended claims rather than the foregoing description and the exemplary embodiments described therein.

What is claimed is:

1. A secure electronic lock, comprising:

a plurality of electronic keys, wherein the plurality of electronic keys comprises an active electronic key and at least a passive electronic key, the active electronic key stores an active digital key and the passive electronic key stores a passive digital key, and the active electronic key comprises an electrical power source and an electronic key communication module, the electrical power source provides electrical power supply to the active electronic key, a passive electronic lock and the passive electronic key, the electronic key communication module transmits an access event of the secure electronic lock to a secure electronic lock system server over a communication network after the secure electronic lock is accessed; and the passive electronic lock, wherein the passive electronic lock comprises:

a plurality of electronic keyholes for receiving a plurality of electronic keys, wherein the plurality of electronic keyholes comprises an active electronic keyhole and at least one passive electronic keyhole, the active electronic keyhole receives an active electronic key, the passive electronic keyhole receives a passive electronic key; and an electronic lock controller, wherein the electronic lock controller comprises a secure electronic lock processor, and an electronic lock non-volatile memory storing an electronic lock operating system and electronic lock computer executable instructions, and the electronic lock computer executable instructions comprise: an electronic lock digital key storage module, an electronic lock digital key control module, an electronic lock digital key encryption/decryption module, an electronic lock digital key authentication module, an electronic lock electrical power module, and an electronic lock control module, when executed by the secure electronic lock processor, the electronic lock computer executable instructions cause the secure electronic lock processor to perform the following operations:

receiving, via the electronic lock electrical power module, electrical power from an active electronic key power supply port of the electronic lock controller from the electrical power source of the active electronic key, when a first user inserts the active electronic key into the active electronic keyhole;

providing, via the electronic lock electrical power module, electrical power to the passive electronic key through a passive electronic key power supply port of the electronic lock controller, when a second user inserts the passive electronic key into the passive electronic keyhole;

receiving an encrypted active digital key from the active electronic key via an encrypted active communication channel of the electronic lock controller, and an encrypted passive digital key from the passive electronic key via a passive communication channel of the electronic lock controller, respectively;

decrypting, by an electronic lock digital key encryption/decryption module of the passive electronic lock, the received encrypted active digital key from the active electronic key and the received encrypted passive digital key from the passive electronic key, and comparing, by an electronic lock digital key control module of the passive electronic lock, the decrypted active digital key and the decrypted passive digital key received with an active digital key and a passive digital key prestored in an electronic lock digital key storage module of the passive electronic lock;

operate, by the electronic lock control module through an electronic locking mechanism, a secure electronic lock tongue to lock or unlock the passive electronic lock, when the electronic lock digital key authentication module determines that the active digital key and the passive digital key received match the active digital key and the passive digital key prestored in the electronic lock digital key storage module of the passive electronic lock, respectively; and transmitting, via the electronic key communication module, an access event of the secure electronic lock to the secure electronic lock system server over the communication network after the secure electronic lock is accessed.

2. The secure electronic lock according to claim 1, wherein the electronic lock computer executable instructions comprise:

the electronic lock digital key storage module, wherein the electronic lock digital key storage module receives the active digital key from the active electronic key and the passive digital key from the passive electronic key generated during an activation process of the secure electronic lock, and stores the active digital key and the passive digital key received in the electronic lock digital key storage module of the passive electronic lock as the active digital key and the passive digital key prestored in the electronic lock digital key storage module of the passive electronic lock for authentication of the active electronic key and the passive electronic key, respectively;

the electronic lock digital key control module, wherein the electronic lock digital key control module receives the active digital key when the active electronic key is inserted in the active electronic keyhole and the passive digital key when the passive electronic key is inserted in the passive electronic keyhole, and compares the active digital key and the passive digital key received with the active digital key and the passive digital key prestored in the electronic lock digital key storage module of the passive electronic lock;

the electronic lock digital key encryption/decryption module, wherein the electronic lock digital key encryption/decryption module decrypts the active digital key and the passive digital key received;

the electronic lock digital key authentication module, wherein the electronic lock digital key authentication module determines whether the active digital key and the passive digital key received match the active digital key and the passive digital key prestored in the electronic lock digital key storage module of the passive electronic lock;

the electronic lock electrical power module, wherein the electronic lock electrical power module receives electrical power supply from the electrical power source of the active electronic key through the active electronic key power supply port and provides electrical power supply to the passive electronic key through the passive electronic key power supply port; and the electronic lock control module, wherein the electronic lock control module controls the operation of the electronic locking mechanism to lock and unlock the passive electronic lock.

3. The secure electronic lock according to claim 1, wherein when the active electronic key is inserted into the active electronic keyhole and the passive electronic key is inserted into the passive electronic keyhole, respectively, the active digital key from the active electronic key is encrypted by the electronic key digital key encryption/decryption module of the active electronic key and transmitted to the passive electronic lock, and the passive digital key from the passive electronic key is encrypted by the electronic key digital key encryption/decryption module of the passive electronic key and transmitted to the passive electronic lock.

4. The secure electronic lock according to claim 1, wherein during an activation process of the secure electronic lock, the first user triggers an electronic lock activation mechanism of the passive electronic lock, the electronic lock digital key control module of the passive electronic lock sends an activation instruction to the active electronic key and the passive electronic key through the active communication channel and the passive communication channel, respectively, the activation instruction instructs the electronic key digital key control module of the active electronic key to generate an active digital key for the active electronic key and the electronic key digital key control module of the passive electronic key to generate a passive digital key for the passive electronic key, the active digital key generated is stored in the electronic key digital key storage module of the active electronic key, the passive digital key generated is stored in the electronic key digital key storage module of the passive electronic key, the active digital key generated is encrypted by the electronic key digital key encryption/decryption module of the active electronic key and transmitted to the electronic lock digital key storage module as the active digital key prestored, the passive digital key generated is encrypted by the electronic key digital key encryption/decryption module of the passive electronic key and transmitted to the electronic lock digital key storage module as the passive digital key prestored, and the active digital key prestored and the passive digital key prestored are used for authentication of the active electronic key and the passive electronic key, respectively.

5. The secure electronic lock according to claim 1, wherein the passive electronic lock is to be locked and unlocked only when the active electronic key and the passive electronic key are simultaneously inserted into the active electronic keyhole and the passive electronic keyhole, respectively, and the first user is a management staff of the secure electronic lock and uses the active electronic key, the second user is a customer and uses the passive electronic key.

6. The secure electronic lock according to claim 1, wherein the active digital key and the passive digital key received are decrypted by the electronic lock digital key encryption/decryption module and authenticated by the electronic lock digital key control module of the passive electronic lock, and the electronic lock control module operates the secure electronic lock tongue through the electronic locking mechanism to lock or unlock the passive electronic lock, when the electronic lock digital key authentication module determines that the active digital key and the passive digital key received match the active digital key and the passive digital key prestored in the electronic lock digital key storage module of the passive electronic lock, respectively.

7. The secure electronic lock according to claim 1, wherein the passive electronic lock comprises a plurality of communication channels and a plurality of electronic key power supply ports, wherein the plurality of communication channels comprises at least the active communication channel for transmitting the active digital key between the active electronic key and the passive electronic lock, and at least the passive communication channel for transmitting the passive digital key between the passive electronic key and the passive electronic lock, and the plurality of electronic key power supply ports comprises at least the active electronic key power supply port for receiving electrical power supply from the active electronic key, and the passive electronic key power supply port for providing electrical power supply to the passive electronic key from the active electronic key through the passive electronic lock.

8. The secure electronic lock according to claim 1, wherein each of the active electronic key and the passive electronic key comprises:

an electronic key processor, and an electronic key non-volatile memory, wherein the electronic key non-volatile memory stores an electronic key operating system and electronic key computer executable instructions, and the electronic key computer executable instructions include:

the electronic key digital key control module, wherein the electronic key digital key control module of the active electronic key generates an active digital key for the active electronic key and the electronic key digital key control module of the passive electronic key generates a passive digital key for the passive electronic key during an activation process of the secure electronic lock, the active digital key and the passive digital key generated are stored in the electronic key digital key storage module of the active electronic key and the electronic key digital key storage module of the passive electronic key, respectively, encrypted using the electronic key digital key encryption/decryption module of the active electronic key and the passive electronic key, respectively, transmitted to and stored in the electronic lock digital key storage module of the passive electronic lock, respectively, for authentication of the active electronic key and the passive electronic key;

the electronic key digital key storage module, wherein the electronic key digital key storage module of the active electronic key receives and stores the active digital key from the electronic key digital key control module of the active electronic key, and the electronic key digital key storage module of the passive electronic key receives and stores the passive digital key from the electronic key digital key control module of the passive electronic key;

the electronic key digital key encryption/decryption module, wherein the electronic key digital key encryption/decryption module of the active electronic key encrypts the active digital key before being transmitted out, and the electronic key digital key encryption/decryption module of the passive electronic key encrypts the passive digital key before being transmitted out; and an electronic key electrical power module, wherein the electronic key electrical power module of the active electronic key receives electrical power supply from the electrical power source and provides electrical power supply to the passive electronic lock, and the electronic key electrical power module of the passive electronic key receives electrical power supply from the active electronic key through the passive electronic lock; and wherein the active electronic key further comprises:

the electronic key communication module, wherein the electronic lock communication module transmits an access event of the secure electronic lock to the secure electronic lock system server over the communication network after the secure electronic lock is accessed.

9. A secure electronic lock system, comprising:

a secure electronic lock system server;

a communication network; and a plurality of secure electronic lock, wherein each of the plurality of secure electronic locks comprises:

a plurality of electronic keys, wherein the plurality of electronic keys comprises an active electronic key and at least a passive electronic key, the active electronic key stores an active digital key and the passive electronic key stores a passive digital key, and the active electronic key comprises an electrical power source, the electrical power source provides electrical power supply to the active electronic key, a passive electronic lock and the passive electronic key; and the passive electronic lock, wherein the passive electronic lock comprises:

a plurality of electronic keyholes for receiving the plurality of electronic keys, wherein the plurality of electronic keyholes comprises an active electronic keyhole and at least one passive electronic keyhole, the active electronic keyhole receives an active electronic key, the passive electronic keyhole receives a passive electronic key; and an electronic lock controller, wherein the electronic lock controller comprises a secure electronic lock processor, and an electronic lock non-volatile memory storing an electronic lock operating system and electronic lock computer executable instructions, and the electronic lock computer executable instructions comprise: an electronic lock digital key storage module, an electronic lock digital key control module, an electronic lock digital key encryption/decryption module, an electronic lock digital key authentication module, an electronic lock electrical power module, an electronic lock control module, and an electronic lock communication module, when executed by the secure electronic lock processor, the electronic lock computer executable instructions cause the secure electronic lock processor to perform the following operations:

receiving, via the electronic lock electrical power module, electrical power from an active electronic key power supply port of the electronic lock controller from the electrical power source of the active electronic key, when a first user inserts the active electronic key into the active electronic keyhole;

providing, via the electronic lock electrical power module, electrical power to the passive electronic key through a passive electronic key power supply port of the electronic lock controller, when a second user inserts the passive electronic key into the passive electronic keyhole;

receiving the active digital key from the active electronic key via an encrypted active communication channel of the electronic lock controller, and an encrypted passive digital key from the passive electronic key via a passive communication channel of the electronic lock controller, respectively;

decrypting, by an electronic lock digital key encryption/decryption module of the passive electronic lock, the received encrypted active digital key from the active electronic key and the received encrypted passive digital key from the passive electronic key, and comparing, by an electronic lock digital key control module of the passive electronic lock, the decrypted active digital key and the decrypted passive digital key received with an active digital key and a passive digital key prestored in an electronic lock digital key storage module of the passive electronic lock;

operate, by the electronic lock control module through an electronic locking mechanism, a secure electronic lock tongue to lock or unlock the passive electronic lock, when the electronic lock digital key authentication module determines that the active digital key and the passive digital key received match the active digital key and the passive digital key prestored in the electronic lock digital key storage module of the passive electronic lock, respectively; and transmitting, via the electronic lock communication module, an access event of the secure electronic lock to the secure electronic lock system server over the communication network after the secure electronic lock is accessed.

10. The secure electronic lock system according to claim 9, wherein the electronic lock computer executable instructions comprise:

the electronic lock digital key storage module, wherein the electronic lock digital key storage module receives the active digital key from the active electronic key and the passive digital key from the passive electronic key generated during an activation process of the secure electronic lock, and stores the active digital key and the passive digital key received in the electronic lock digital key storage module of the passive electronic lock as the active digital key and the passive digital key prestored in the electronic lock digital key storage module of the passive electronic lock for authentication of the active electronic key and the passive electronic key, respectively;

the electronic lock digital key control module, wherein the electronic lock digital key control module receives the active digital key when the active electronic key is inserted in the active electronic keyhole and the passive digital key when the passive electronic key is inserted in the passive electronic keyhole, and compares the active digital key and the passive digital key received with the active digital key and the passive digital key prestored in the electronic lock digital key storage module of the passive electronic lock;

the electronic lock digital key encryption/decryption module, wherein the electronic lock digital key encryption/decryption module decrypts the active digital key and the passive digital key received;

the electronic lock digital key authentication module, wherein the electronic lock digital key authentication module determines whether the active digital key and the passive digital key received match the active digital key and the passive digital key prestored in the electronic lock digital key storage module of the passive electronic lock;

an electronic lock electrical power module, wherein the electronic lock electrical power module receives electrical power supply from the electrical power source of the active electronic key through the active electronic key power supply port and provides electrical power supply to the passive electronic key through the passive electronic key power supply port;

the electronic lock control module, wherein the electronic lock control module controls the operation of the electronic locking mechanism to lock and unlock the passive electronic lock; and the electronic lock communication module, wherein the electronic lock communication module transmits an access event of the secure electronic lock to the secure electronic lock system server over the communication network after the secure electronic lock is accessed.

11. The secure electronic lock system according to claim 9, wherein each of the active electronic key and the passive electronic key comprises:

an electronic key processor, and an electronic key non-volatile memory, wherein the electronic key non-volatile memory stores an electronic key operating system and electronic key computer executable instructions, and the electronic key computer executable instructions include:

the electronic key digital key control module, wherein the electronic key digital key control module of the active electronic key generates an active digital key for the active electronic key and the electronic key digital key control module of the passive electronic key generates a passive digital key for the passive electronic key during an activation process of the secure electronic lock, the active digital key and the passive digital key generated are stored in the electronic key digital key storage module of the active electronic key and the electronic key digital key storage module of the passive electronic key, respectively, encrypted using the electronic key digital key encryption/decryption module of the active electronic key and the passive electronic key, respectively, transmitted to and stored in the electronic lock digital key storage module of the passive electronic lock, respectively, for authentication of the active electronic key and the passive electronic key;

the electronic key digital key storage module, wherein the electronic key digital key storage module of the active electronic key receives and stores the active digital key from the electronic key digital key control module of the active electronic key, and the electronic key digital key storage module of the passive electronic key receives and stores the passive digital key from the electronic key digital key control module of the passive electronic key;

the electronic key digital key encryption/decryption module, wherein the electronic key digital key encryption/decryption module of the active electronic key encrypts the active digital key before being transmitted out, and the electronic key digital key encryption/decryption module of the passive electronic key encrypts the passive digital key before being transmitted out; and an electronic key electrical power module, wherein the electronic key electrical power module of the active electronic key receives electrical power supply from the electrical power source and provides electrical power supply to the passive electronic lock, and the electronic key electrical power module of the passive electronic key receives electrical power supply from the active electronic key through the passive electronic lock.

12. The secure electronic lock system according to claim 9, wherein when the active electronic key is inserted into the active electronic keyhole and the passive electronic key is inserted into the passive electronic keyhole, respectively, the active digital key from the active electronic key is encrypted by the electronic key digital key encryption/decryption module of the active electronic key and transmitted to the passive electronic lock, and the passive digital key from the passive electronic key is encrypted by the electronic key digital key encryption/decryption module of the passive electronic key and transmitted to the passive electronic lock.

13. The secure electronic lock system according to claim 9, wherein during an activation process of the secure electronic lock, the first user triggers an electronic lock activation mechanism of the passive electronic lock, the electronic lock digital key control module of the passive electronic lock sends an activation instruction to the active electronic key and the passive electronic key through the active communication channel and the passive communication channel, respectively, the activation instruction instructs the electronic key digital key control module of the active electronic key to generate an active digital key for the active electronic key and the electronic key digital key control module of the passive electronic key to generate a passive digital key for the passive electronic key, the active digital key generated is stored in the electronic key digital key storage module of the active electronic key, the passive digital key generated is stored in the electronic key digital key storage module of the passive electronic key, the active digital key generated is encrypted by the electronic key digital key encryption/decryption module of the active electronic key and transmitted to the electronic lock digital key storage module as the active digital key prestored, the passive digital key generated is encrypted by the electronic key digital key encryption/decryption module of the passive electronic key and transmitted to the electronic lock digital key storage module as the passive digital key prestored, and the active digital key prestored and the passive digital key prestored are used for authentication of the active electronic key and the passive electronic key, respectively.

14. The secure electronic lock system according to claim 9, wherein the passive electronic lock is to be locked and unlocked only when the active electronic key and the passive electronic key are simultaneously inserted into the active electronic keyhole and the passive electronic keyhole, respectively, and the first user is a management staff of the secure electronic lock and uses the active electronic key, the second user is a customer and uses the passive electronic key.

15. The secure electronic lock system according to claim 9, wherein the active digital key and the passive digital key received are decrypted by the electronic lock digital key encryption/decryption module and authenticated by the electronic lock digital key control module of the passive electronic lock, and the electronic lock control module operates the secure electronic lock tongue through the electronic locking mechanism to lock or unlock the passive electronic lock, when the electronic lock digital key authentication module determines that the active digital key and the passive digital key received match the active digital key and the passive digital key prestored in the electronic lock digital key storage module of the passive electronic lock, respectively.

16. The secure electronic lock system according to claim 9, wherein the passive electronic lock comprises a plurality of communication channels and a plurality of electronic key power supply ports, wherein the plurality of communication channels comprises at least the active communication channel for transmitting the active digital key between the active electronic key and the passive electronic lock, and at least the passive communication channel for transmitting the passive digital key between the passive electronic key and the passive electronic lock, and the plurality of electronic key power supply ports comprises at least the active electronic key power supply port for receiving electrical power supply from the active electronic key, and the passive electronic key power supply port for providing electrical power supply to the passive electronic key from the active electronic key through the passive electronic lock.

17. A method of using a secure electronic lock system, comprising:

installing the secure electronic lock system, wherein the secure electronic lock system comprises: a secure electronic lock system server, a communication network, and a plurality of secure electronic locks connected to the secure electronic lock system server over the communication network, and each of the plurality of secure electronic locks comprises: an active electronic key, a passive electronic key, and a passive electronic lock having a plurality of electronic keyholes for receiving the active electronic key and the passive electronic key;

inserting, by a first user, the active electronic key into an active electronic keyhole of the passive electronic lock, wherein the active electronic key comprises an electrical power source to provide electrical power supply to the passive electronic lock through an active electronic key power supply port of the active electronic key, and an encrypted active digital key to the passive electronic lock through an active communication channel of the active electronic key;

inserting, by a second user while the active electronic key is inserted in the active electronic keyhole, the passive electronic key into a passive electronic keyhole of the passive electronic lock to receive electrical power supply from the passive electronic lock through a passive electronic key power supply port of the passive electronic key, and to provide an encrypted passive digital key to the passive electronic lock through a passive communication channel of the passive electronic key;

decrypting, by an electronic lock digital key encryption/decryption module of the passive electronic lock, the received encrypted active digital key from the active electronic key and the received encrypted passive digital key from the passive electronic key, and comparing, by an electronic lock digital key control module of the passive electronic lock, the decrypted active digital key and the decrypted passive digital key received with an active digital key and a passive digital key prestored in an electronic lock digital key storage module of the passive electronic lock; and operating, by the electronic lock digital key control module of the passive electronic lock, a secure electronic lock tongue of the passive electronic lock through an electronic lock control module and an electronic locking mechanism to lock and unlock the passive electronic lock, when an electronic lock digital key authentication module of the passive electronic lock determines that the active digital key and the passive digital key received match the active digital key and the passive digital key prestored in the electronic lock digital key storage module of the passive electronic lock of the passive electronic lock, respectively; and transmitting, via an electronic lock communication module of the passive electronic lock, an access event of the secure electronic lock to the secure electronic lock system server over the communication network after the secure electronic lock is accessed.

18. The method according to claim 17, wherein the passive electronic lock is to be locked and unlocked only when the active electronic key and the passive electronic key are simultaneously inserted into the active electronic keyhole and the passive electronic keyhole, respectively, and the first user is a management staff of the secure electronic lock and uses the active electronic key, the second user is a customer and uses the passive electronic key.

19. The method according to claim 17, wherein each of the active electronic key and the passive electronic key comprises:

an electronic key processor, and an electronic key non-volatile memory, wherein the electronic key non-volatile memory stores an electronic key operating system and electronic key computer executable instructions, and the electronic key computer executable instructions include:

the electronic key digital key control module, wherein the electronic key digital key control module of the active electronic key generates an active digital key for the active electronic key and the electronic key digital key control module of the passive electronic key generates a passive digital key for the passive electronic key during an activation process of the secure electronic lock, the active digital key and the passive digital key generated are stored in the electronic key digital key storage module of the active electronic key and the electronic key digital key storage module of the passive electronic key, respectively, encrypted using the electronic key digital key encryption/decryption module of the active electronic key and the passive electronic key, respectively, transmitted to and stored in the electronic lock digital key storage module of the passive electronic lock, respectively, for authentication of the active electronic key and the passive electronic key;

the electronic key digital key storage module, wherein the electronic key digital key storage module of the active electronic key receives and stores the active digital key from the electronic key digital key control module of the active electronic key, and the electronic key digital key storage module of the passive electronic key receives and stores the passive digital key from the electronic key digital key control module of the passive electronic key;

the electronic key digital key encryption/decryption module, wherein the electronic key digital key encryption/decryption module of the active electronic key encrypts the active digital key before being transmitted out, and the electronic key digital key encryption/decryption module of the passive electronic key encrypts the passive digital key before being transmitted out; and an electronic key electrical power module, wherein the electronic key electrical power module of the active electronic key receives electrical power supply from the electrical power source and provides electrical power supply to the passive electronic lock, and the electronic key electrical power module of the passive electronic key receives electrical power supply from the active electronic key through the passive electronic lock.

20. The method according to claim 17, wherein the passive electronic lock comprises an electronic lock controller having an electronic lock processor, and an electronic lock non-volatile memory storing an electronic lock operating system and electronic lock computer executable instructions, and the electronic lock computer executable instructions comprise:

the electronic lock digital key storage module, wherein the electronic lock digital key storage module receives the active digital key from the active electronic key and the passive digital key from the passive electronic key generated during an activation process of the secure electronic lock, and stores the active digital key and the passive digital key received in the electronic lock digital key storage module of the passive electronic lock as the active digital key and the passive digital key prestored in the electronic lock digital key storage module of the passive electronic lock for authentication of the active electronic key and the passive electronic key, respectively;

the electronic lock digital key control module, wherein the electronic lock digital key control module receives the active digital key when the active electronic key is inserted in the active electronic keyhole and the passive digital key when the passive electronic key is inserted in the passive electronic keyhole, and compares the active digital key and the passive digital key received with the active digital key and the passive digital key prestored in the electronic lock digital key storage module of the passive electronic lock;

the electronic lock digital key encryption/decryption module, wherein the electronic lock digital key encryption/decryption module decrypts the active digital key and the passive digital key received;

the electronic lock digital key authentication module, wherein the electronic lock digital key authentication module determines whether the active digital key and the passive digital key received match the active digital key and the passive digital key prestored in the electronic lock digital key storage module of the passive electronic lock;

an electronic lock electrical power module, wherein the electronic lock electrical power module receives electrical power supply from the electrical power source of the active electronic key through the active electronic key power supply port and provides electrical power supply to the passive electronic key through the passive electronic key power supply port;

the electronic lock control module, wherein the electronic lock control module controls the operation of the electronic locking mechanism to lock and unlock the passive electronic lock; and the electronic lock communication module, wherein the electronic lock communication module transmits an access event of the secure electronic lock to the secure electronic lock system server over the communication network after the secure electronic lock is accessed.

* * * * *